US005680507A

United States Patent [19]

Chen

[11] Patent Number: 5,680,507

[45] Date of Patent: Oct. 21, 1997

[54] ENERGY CALCULATIONS FOR CRITICAL AND NON-CRITICAL CODEBOOK VECTORS

[75] Inventor: Juin-Hwey Chen, Neshanic Station, N.J.

[73] Assignee: Lucent Technologies Inc., Murray Hill, N.J.

[21] Appl. No.: 564,611

[22] Filed: Nov. 29, 1995

Related U.S. Application Data

[62] Division of Ser. No. 57,068, May 3, 1993, which is a continuation of Ser. No. 757,168, Sep. 10, 1991, Pat. No. 5,233,660.

[51] Int. Cl.[6] ..... G10L 5/00

[52] U.S. Cl. ..... 395/2.32; 395/2.28

[58] Field of Search ..... 395/2.28–2.32, 395/2.52, 2.54

[56] References Cited

U.S. PATENT DOCUMENTS 4,868,867 9/1989 Davidson et al. ..... 395/2.32

5,195,137 3/1993 Swaminathan ..... 395/2.31

5,444,816 8/1995 Adoul et al. ..... 395/2.28

*Primary Examiner*—David D. Knepper

*Attorney, Agent, or Firm*—Kenneth M. Brown; William Ryan; David M. Rosenblatt

[57] ABSTRACT

Codebook vectors may be considered critical if they give poor energy approximations and exhibit a particular shape with smaller components near the beginning and larger components toward the end of the vector. Standard deviation may be used to identify critical codevectors based on energy approximation error measured in decibels. A low-bit rate (typically 8 kbit/s or less), low-delay digital coder and decoder based on Code Excited Linear Prediction for speech and similar signals features backward adaptive adjustment for codebook gain and short-term synthesis filter parameters and forward adaptive adjustment of long-term (pitch) synthesis filter parameters. In addition, the coder makes use of an excitation codebook and the coding is based on a set of codebook vector energies for a set of codebook vectors in the codebook. The codebook energies are calculated by identifying a set of approximations for the non-critical codebook vector energies. This achieves a significant reduction in processing time in comparison with prior art techniques.

20 Claims, 6 Drawing Sheets

*FIG.* 9A
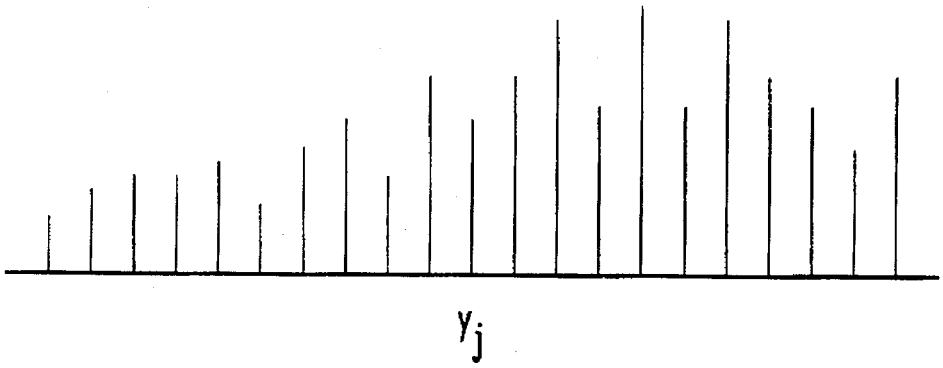
*FIG.* 9B
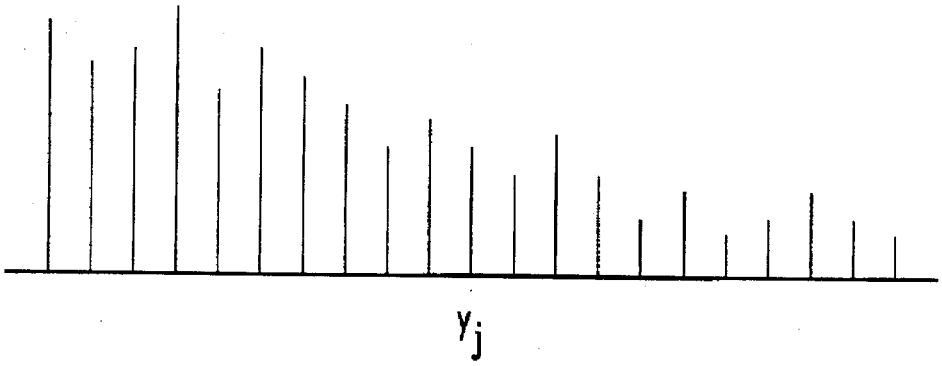

ENERGY CALCULATIONS FOR CRITICAL AND NON-CRITICAL CODEBOOK VECTORS

This is a division of application Ser. No. 08/057,068 filed May 3, 1993 which is a continuation of Ser. No. 07/757,168 filed Sep. 10, 1992 (now U.S. Pat. No. 5,233,660 issued Aug. 3, 1993.

FIELD OF THE INVENTION

The present invention relates to the field of efficient coding of speech and related signals for transmission and storage, and the subsequent decoding to reproduce the original signals with high efficiency and fidelity.

BACKGROUND OF THE INVENTION

Many techniques have been developed in recent years for reducing the amount of information that must be provided to communicate speech to a remote location or to store speech information for subsequent retrieval and reproduction. An important consideration is the rate at which such code information must be generated to adequately meet the high quality requirements of the coding scheme. For example, in some important applications speech is represented by digital signals occurring at 32 kilobits per second (kbit/s). It is, of course, desirable to represent speech with as few digital signals as possible to minimize storage and transmission bandwidth requirements.

Among the most common techniques currently used are those collectively known as linear predictive coding techniques. Within this broad category of coding techniques, that known as Code Excited Linear Predictive (CELP) coding has received much attention in recent years. An early overview of the CELP approach is provide in M. R. Schroeder and B. S. Atal, "Code Excited Linear Prediction (CELP): High-Quality Speech at Very Low Bit Rates," *Proc. IEEE Int. Conf. Acoust. Speech, Signal Processing,* pp. 937–940 (1985).

Another coding constraint that arises in many circumstances is the delay needed to perform the coding of speech. Thus, for example, low delay coding is highly effective to reduce the effects of echoes and to impose lesser demands on echo suppressors in communication links. Further, in those circumstances, such as cellular communication systems, where permitted total delay is limited, and where channel coding delays are an important aspect of channel error control, it is highly desirable that the original speech coding not consume a significant portion of the available total delay "resource."

To date, most speech coders for use at or below 16 kbit/s buffer a large block of speech samples in seeking to achieve good speech quality. This block of samples typically includes samples of speech over approximately a 20 millisecond (ms) interval, to permit the application of well known transform, prediction, or sub-band techniques to exploit the redundancy in the buffered speech. However, with processing delay and bit transmission delay added to the buffering delay, the total one-way coding delay of these conventional coders is typically around 50 to 60 ms. As noted, such a long delay is not desirable, or even tolerable, in many applications.

A recent goal of an international standards group has focused on the problem of low-delay CELP coding for 16 kbit/s speech coding. See, *CCITT Study Group XVIII, Terms of reference of the ad hoc group on 16 kbits/s speech coding (Annex 1 to question U/XV)*, June, 1988. The requirement posed by the CCITT group was that coding delay was not to exceed 5 msec, with the goal being 2 msec. Solutions to the problem posed by the CCITT group have been provided, e.g., in J.-H. Chen, "A robust low-delay CELP speech coder at 16 kbits/s," *Proc. IEEE Global Commun. Conf.,* pp. 1237–1241 (November 1989); J.-H. Chen, "High-quality 16 kb/s speech coding with a one-way delay less than 2 ms," *Proc. IEEE Int. Conf. Acoust., Speech, Signal Processing,* pp. 453–456 (April, 1990); and J.-H. Chen, M. J. Melchner, R. V. Cox, and D. O. Bowker, "Real-time implementation of a 16 kb/s low-delay CELP speech coder," *Proc. IEEE Int. Conf. Acoust., Speech, Signal Processing,* pp. 181–184 (April 1990).

Recently, the CCITT went one step further and planned to standardize an 8 kb/s speech coding algorithm. Again, all candidate algorithms are required to have low delay, but this time the one-way delay requirement has been relaxed somewhat to about 10 ms.

At 8 kb/s, it is much more difficult to achieve good speech quality with low delay than at 16 kb/s. This is, in part, because current low-delay CELP coders update their predictor coefficients based on previously coded speech, the so-called "backward adaptation" technique. See, for example, N. S. Jayant, and P. Noll, *Digital Coding of Waveforms,* Prentice-Hall, Inc., Englewood Cliffs, N.J. (1984). Additionally, higher coding noise level in 8 kb/s coded speech makes backward adaptation significantly less effective than at 16 kb/s.

Prior to the 8 kbit/s low delay coder challenge posed by the CCITT, little or nothing was published in the literature on the subject. Since the challenge, T. Moriya, in "Medium-delay 8 kbit/s speech coder based on conditional pitch prediction", *Proc. of Int. Conf. Spoken Language Processing,* (November, 1990), has proposed a 10 ms delay 8 kb/s CELP coder based on the backward adaptation techniques of 16 kb/s LD-CELP described, e.g., in the above cited 1989 Chen paper. This 8 kb/s coder was reportly capable of outperforming conventional 8 kb/s CELP coder described in the above-cited Schroeder and Atal 1985 paper and in P. Kroon and B. S. Atal, "Quantization procedures for 4.8 kbps CELP coders," *Proc. IEEE Int. Conf. Acoust., Speech, Signal Processing,* pp. 1650–1654 (1987). However, such performance was possible only if delayed decision coding code excitation vector was used (at a price of very high computational complexity). On the other hand, if delayed decision was not used, then the speech quality degraded and became slightly inferior to that of conventional 8 kb/s CELP.

The Moriya coder first performed backward adaptive pitch analysis to determine 8 pitch candidates, and then transmitted 3 bits to specify the selected candidate. Since backward pitch analysis is known to be very sensitive to channel errors (see Chen 1989 reference, above), this coder is likely to be very sensitive to channel errors as well.

SUMMARY OF THE INVENTION

In accordance with the present invention, a coder which makes use of an excitation codebook is provided wherein the coding is based on a set of codebook vector energies for a set of codebook vectors in the codebook. In particular, the codebook energies are calculated by identifying a set of critical codebook vectors and a set of non-critical codebook vectors, calculating the critical codebook vector energies for the critical codebook vectors, and calculating a set of approximations for the non-critical codebook vector energies. In this manner, a significant reduction in processing time may be achieved in comparison with prior art techniques.

The present invention provides low-bit-rate low-delay coding and decoding by using an approach different from the prior art, while avoiding many of the potential limitations and sensitivities of the prior coders. Speech processed by the present invention is of the same quality as for conventional CELP, but such speech can be provided with only about one-fifth of the delay of conventional CELP. Additionally, the present invention avoids many of the complexities of the prior art, to the end that a full-duplex coder can be implemented in a preferred form on a single digital signal processing (DSP) chip. Further, using the coding and decoding techniques of the present invention two-way speech communication can be readily accomplished even under conditions of high bit error rates.

These results am obtained in an illustrative embodiment of the present invention in a CELP coder in which the excitation gain factor and short-term (LPC) predictor is updated using so-called backward adaptation. In this regard, the illustrative embodiment bears some similarity to (but also has important differences from) the 16 kbit/s low-delay coders described in above-cited papers. The all-important pitch parameters, however, are forward transmitted in this illustrative embodiment to achieve higher speech quality and better robustness to channel errors.

The pitch predictor advantageously used in the typical embodiment of the present invention is a 3-tap pitch predictor in which the pitch period is coded using an inter-frame predictive coding technique, and the 3 taps are vector quantized with a closed-loop codebook search. As used here, "closed-loop" means that the codebook search seeks to minimize the perceptually weighted mean-squared error of the coded speech. This scheme is found to save bits, provide high pitch prediction gain (typically 5 to 6 dB), and to be robust to channel errors. The pitch period is advantageously determined by a combination of open-loop and closed-loop search methods.

The backward gain adaptation used in the the above-described 16 kbit/s low-delay coder is also used to advantage in illustrative embodiments of the present invention. It also proves advantageous to use frame sizes representing smaller time intervals (e.g., only 2.5 to 4.0 ms) as compared to the 15–30 used in conventional CELP implementations.

Other enhancements described in the following detailed description of an illustrative embodiment include the populating of the excitation codebook with vectors obtained by a closed-loop training technique.

To further enhance speech quality, a postfilter (e.g., one similar to that proposed in J-H. Chen, *Low-bit-rate predictive coding of speech waveforms based on vector quantization,* Ph.D. dissertation, U. of Calif., Santa Barbara, (March 1987)) is advantageously used at a decoder in an illustrative embodiment of the present invention. Moreover, it proves advantageous to use both a short-term postfilter and a long-term postfilter.

BRIEF DESCRIPTION OF THE DRAWING

FIG. 9 illustrates critical and non-critical codebook vectors in FIG. 9A and 9B, respectively.

DETAILED DESCRIPTION

To facilitate a better understanding of the present invention, a brief review of the conventional CELP coder will be provided. Then the departures (at the element and system level) provided by the present invention will be described. Finally, details of a typical illustrative embodiment of the present invention will be provided.

Review of Conventional CELP

Figure 1:
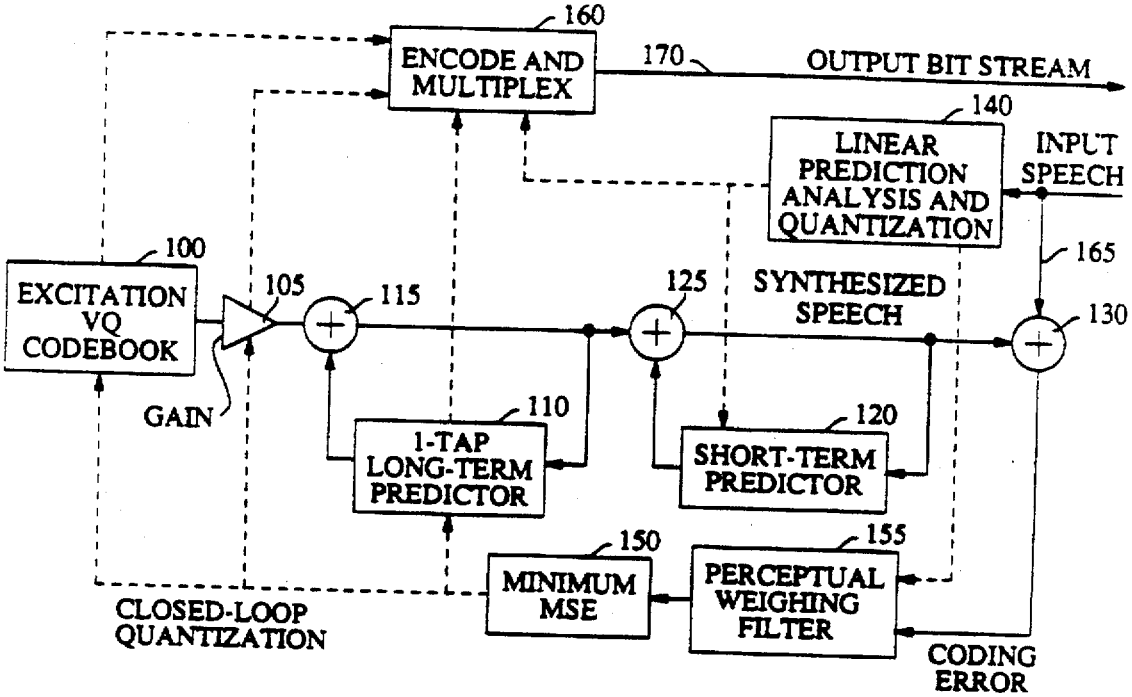
FIG. 1 (PRIOR ART)
FIG. 1 shows a prior art CELP coder.

FIG. 1 shows a typical conventional CELP speech coder. Viewed generally, the CELP coder of FIG. 1 synthesizes speech by passing an excitation sequence from excitation codebook 100 through a gain scaled element 105 and then to a cascade of a long-term synthesis filter and a short-term synthesis filter. The long-term synthesis filter comprises a long-term predictor 110 and the summer element 115, while the short-term synthesis filter comprises a short-term predictor 120 and summer 125. As is well known in the art, both of the synthesis filters typically are all-pole filters, with their respective predictors connected in the indicated feedback loop.

The output of the cascade of the .long-term and short-term synthesis filters is the aforementioned synthesized speech. This synthesized speech is compared in comparator 130 with the input speech, typically in the form of a frame of digitized samples. The synthesis and comparison operations are repeated for each of the excitation sequence in codebook 100, and the index of the sequence giving the best match is used for subsequent decoding along with additional information about the system parameters. Basically, the CELP coder encodes speech frame-by-frame, striving for each frame to find the best predictors, gain, and excitation such that a perceptually weighted mean-squared error (MSE) between the input speech and the synthesized speech is minimized.

The long-term predictor is often referred to as the pitch predictor, because its main function is to exploit the pitch periodicity in voiced speech. Typically, a one-tap pitch predictor is used, in which case the predictor transfer function is $P_1(z)=\beta z^{-p}$, where p is the bulk delay, or pitch period, and $\beta$ is the predictor tap. The short-term predictor is sometimes referred to as the LPC predictor, because it is also used in the well-known LPC (Linear Predictive Coding) vocoders which operate at bitrates of 2.4 kbit/s or lower. The LPC predictor is typically a tenth-order predictor with a transfer function of $$P_2(z)=\sum_{i=1}^{10} a_i z^{-i}.$$

The excitation vector quantization (VQ) codebook contains a table of codebook vectors (or codevectors) of equal length. The codevectors are typically populated by Gaussian random numbers with possible center-clipping.

More particularly, the CELP encoder in FIG. 1 encodes speech waveform samples frame-by-frame (each fixed-length frame typically being 15 to 30 ms long) by first performing linear prediction analysis (LPC analysis) of the kind described generally in L. R. Rabiner and R. W. Schafer, *Digital Processing of Speech Signals,* Prentice-Hall, Inc. Englewood Cliffs, N.J., (1978) on the input speech. The resulting LPC parameters are then quantized in a standard open-loop manner. The LPC analysis and quantization am represented in FIG. 1 by the element 140.

It also proves convenient in the standard CELP coding in accordance with FIG. 1 to divide each speech frame into several equal-length sub-frames or vectors containing the samples occurring in a 4 to 8 ms interval within the frame. The quantized LPC parameters are usually interpolated for each sub-frame and converted to LPC predictor coefficients. Then, for each sub-frame, the parameters of the one-tap pitch predictor are closed-loop quantized. Typically, the pitch period is quantized to 7 bits and the pitch predictor tap is quantized to 3 or 4 bits. Next, the best codevector from the excitation VQ codebook and the best gain are determined by minimum mean square error (MSE) element 150, based on inputs that are perceptually weighted by filter 155, for each sub-frame, again by closed-loop quantization.

The quantized LPC parameters, pitch predictor parameters, gains, and excitation codevectors of each sub-frame are encoded into bits and multiplexed together into the output bit stream by encoder/multiplexer 160 in FIG. 1.

Figure 2:
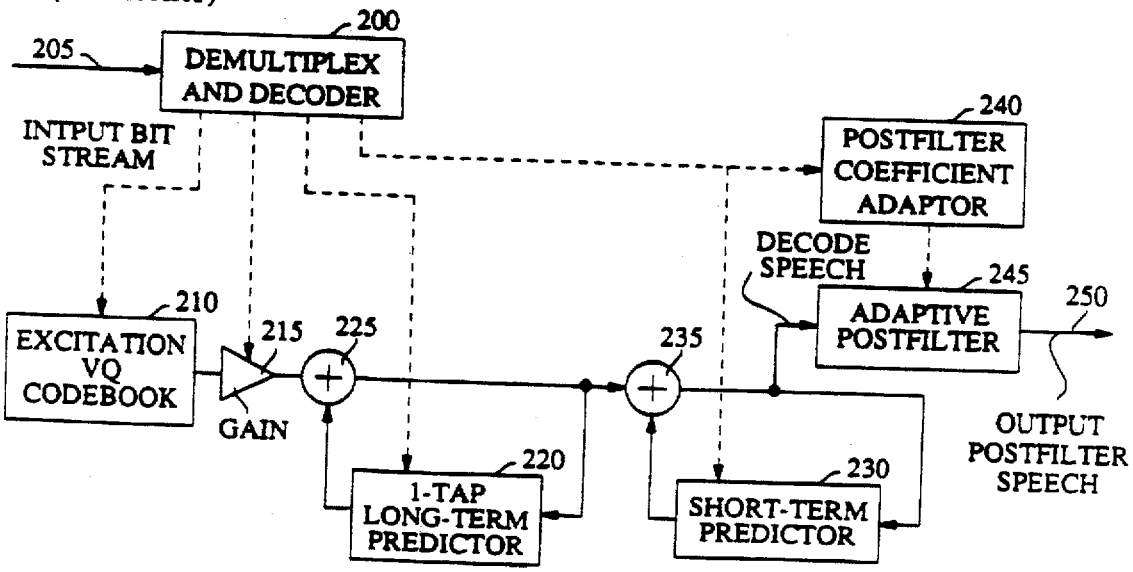
FIG. 2 (PRIOR ART)
FIG. 2 shows a prior art CELP decoder.

The CELP decoder shown in FIG. 2 decodes speech frame-by-frame. As indicated by element 200 in FIG. 2, the decoder first demultiplexes the input bit stream and decodes the LPC parameters, pitch predictor parameters, gains, and the excitation codevectors. The excitation codevector identified by multiplexer 200 for each sub-frame is then scaled by the corresponding gain factor in gain element 215 and passed through the cascaded long term synthesis filter (comprising long-term predictor 220 and summer 225) and short-term synthesis filter (comprising short-term predictor 230 and its summer 235) to obtain the decoded speech.

An adaptive postfilter, e.g., of the type proposed in J.-H. Chen and A. Gersho, "Real-time vector APC speech coding at 48000 bps with adaptive postfiltering", *Proc. Int. Cobnf. Acoust., Speech, Signal Processing,* ASSP-29(5), pp. 1062–1066 (October, 1987), is typically used at the output of the decoder to enhance the perceptual speech quality.

As described above, a CELP coder typically determines LPC parameters directly from input speech and open-loop quantizes them, but the pitch predictor, the gain, and the excitation are all determined by closed-loop quantization. All these parameters are encoded and transmitted to the CELP decoder.

Overview of Low-Bitrate, Low-Delay CELP

Figure 3:
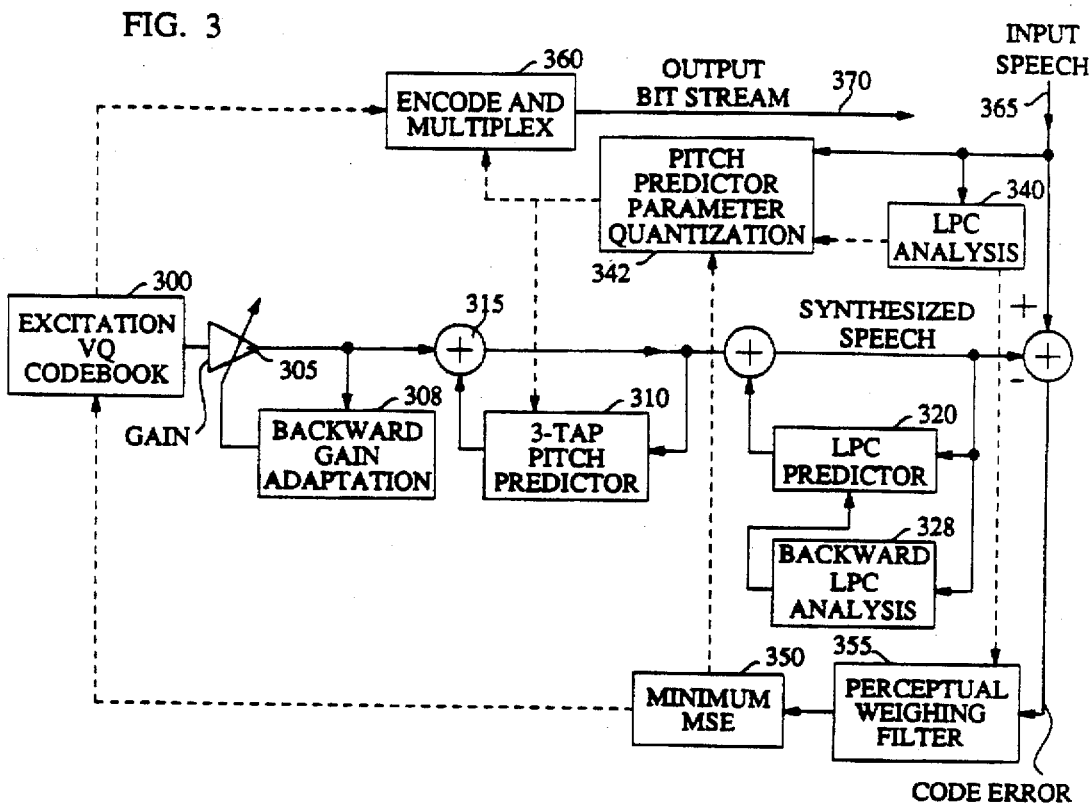
FIG. 3 shows an illustrative embodiment of a low-bitrate, low-delay CELP coder in accordance with the present invention.
Figure 4:
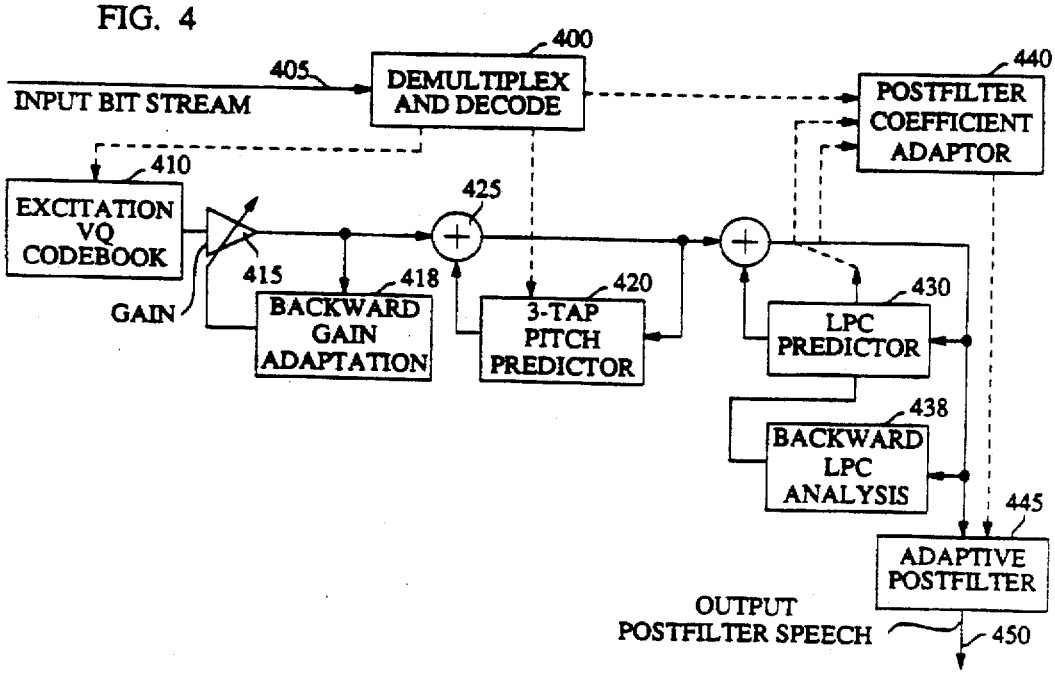
FIG. 4 shows an illustrative embodiment of a low-bitrate, low-delay decoder in accordance with the present invention.

FIGS. 3 and 4, show an overview of an illustrative embodiment of a low-delay Code Excited Linear Prediction (LD-CELP) encoder and decoder, respectively, in accordance with aspects of the present invention. For convenience, this illustrative embodiment will be described in terms of the desiderata of the CCITT study of the 8 kb/s LD-CELP system and method. It should be understood, however, that the structure, algorithms and techniques to be described apply equally well to systems and method operating at different particular bitrates and coding delays.

In FIG. 3, input speech in convenient framed-sample format appearing on input 365 is again compared in a comparator 341 with synthesized speech generated by passing vectors from excitation codebook 300 through gain adjuster 305 and the cascade of a long-term synthesis filter and a short-term synthesis filter. In the illustrative embodiment of FIG. 3, the gain adjuster is seen to be a backward adaptive gain adjuster as will be discussed more completely below. The long-term synthesis filter illustratively comprises a 3-tap pitch predictor 310 in a feedback loop with summer 315. The pitch predictor functionality will be discussed in more detail below. The short-term synthesis filter comprises a 10-tap backward-adaptive LPC predictor 320 in a feedback loop with summer 325. The backward adaptive functionality represented by element 328 will be discussed further below.

Mean square error evaluation for the codebook vectors is accomplished in element 350 based on perceptually weighted error signals provided by way of filter 355. Pitch predictor parameter quantization used to set values in pitch predictor 310 is accomplished in element 342, as will be discussed in greater detail below. Other aspects of the interrelation of the elements of the illustrative embodiment of a low-delay CELP coder shown in FIG. 3 will appear as the several elements are discussed more fully below.

The illustrative embodiment of a low-delay CELP decoder shown in FIG. 4 operates in a complementary fashion to the illustrative coder of FIG. 3. More specifically, the input bit stream received on input 405 is decoded and demultiplexed in element 400 to provide the necessary codebook element identification to excitation codebook 410, as well as pitch predictor tap and pitch period information to the long-term synthesis filter comprising the illustrative 3-tap pitch predictor 420 and summer 425. Also provided by element 400 is postfilter coefficient information for the adaptive postfilter adaptor 440. In accordance with an aspect of the present invention, postfilter 445 includes both long-term and short-term postfiltering functionality, as will be described more fully below. The output speech appears on output 450 after postfiltering in element 445.

The decoder of FIG. 4 also includes a short-term synthesis filter comprising LPC predictor 430 (typically a 10-tap predictor) connected in a feedback loop with summer 435. The adaptation of short-term filter coefficients is accomplished using a backward-adaptive LPC analysis by element 438.

From the foregoing discussion of conventional CELP coders in connection with FIGS. 1 and 2, it can be said that generally the conventional CELP coders transmit long-term and short-term filter information, excitation gain information and excitation vector information to a decoder to permit forward adaptation for all of these coding components. The solutions to the CCITT 16 kbit/s low-delay CELP requirements described in the Chen papers, supra, indicate that such solutions usually use backward adaptation for all code information except the excitation. In these 16 kbit/s low-delay coders, explicit pitch information is not used.

As can be seen from FIGS. 3 and 4, however, the low-delay, low- bitrate coder/decoder in accordance with aspects of the present invention typically forward transmits pitch predictor parameters and the excitation codevector index. It has been found that there is no need to transmit the gain and the LPC predictor, since the decoder can use backward adaptation to locally derive them from previously quantized signals.

Having briefly summarized the differences between conventional CELP, 16 kbit/s low-delay CELP and low-delay CELP coders in accordance with aspects of the present invention, individual elements of an illustrative embodiment of the present invention will now be described in more detail in the following sections.

LPC Prediction

In a typical application, to achieve a one-way coding delay of 10 ms or less, a CELP coder cannot have a frame buffer size larger than 3 or 4 ms, or 24 to 32 speech samples at a sampling rate of 8 kHz. It proved convenient to investigate the trade-off between coding delay and speech quality, to cream two versions of an 8 kb/s LD-CELP algorithm. The first version has a frame size of 32 samples (4 ms) and a one-way delay of approximately 10 ms, while the second one has a frame size of 20 samples (2.5 ms) and a delay approximately 7 ms.

At 8 kb/s, or 1 bit/sample, there are only 20 or 32 bits to spend in each frame. Since in CELP coding it is important to use the majority of bits in excitation coding in order to achieve good speech quality, this implies that very few bits are left for non-excitation information such as LPC and pitch parameters.

Therefore, with the low delay constraint (and hence the frame size constraint), it is convenient to update the LPC predictor coefficients by backward adaptation, as described, e.g., in the 1989 paper by Chen, supra. Such backward adaptation of LPC parameters does not require transmission of bits to specify LPC parameters. This should be contrasted with the approach described in the above-cited Moriya paper where a less than successful partially backward, partially forward adaptation scheme is proposed for LPC parameter adaptation.

Since the backward-adaptive LPC parameter approach used in the 16 kb/s low-delay CELP is advantageously retained, it would be natural to merely try changing the parameters used in the 16 kb/s LD-CELP algorithm to make it run at 8 kb/s. Experiments with this scaled down approach yielded results which, though intelligible, were too noisy for the intended purposes. Thus the illustrative embodiments of the present invention feature an explicit derivation of pitch information and the use of a pitch predictor. An important advantage of using a pitch predictor in the coding and decoding operations is that the short-term predictor used in the 16 kb/s low-delay method could be simplified, typically from the prior 50-tap LPC predictor to a simpler 10-tap LPC predictor.

The illustrative 10-tap LPC predictor used in the arrangement of FIGS. 3 and 4 is updated once a frame using the autocorrelation method of LPC analysis described in the Rabiner and Schafer book, supra. In a convenient floating-point implementation using a standard AT&T DSP32C digital signal processor chip, the autocorrelation coefficients are calculated by using a modified Barnwell recursive window described in J.-H. Chen, "High-quality 16 kb/s speech coding with a one-way delay less than 2 ms," *Proc. IEEE Int. Conf. Acoust., Speech, Signal Processing,* pp. 453–456 (April, 1990) and T. P. Barnwell, III, "Recursive windowing for generating autocorrelation coefficients for LPC analysis," *IEEE Trans. Acoust., Speech, Signal Processing,* ASSP-29(5) pp. 1062–1066 (October, 1981). For fixed point implementations, it may prove more advantageous to use a hybrid window of the type described in J.-H. Chen, Y.-C. Lin and R. V. Cox, "A Fixed-Point 16 kb/s LD-CELP Algorithm," *Proc. IEEE Int. Conf. Acoust., Speech, Signal Processing,* pp. 21–24 (May, 1991). The window function of the recursive window is basically a mirror image of the impulse response of a two-pole filter with a transfer function of $$\frac{1}{[1-\alpha z^{-1}]^2}.$$

The closer the pole $\alpha$ is to unity, the longer the "tail" of the window.

It will be found that the window shape for the backward-adaptive LPC analysis should be chosen very carefully, or else significant performance degradation will result. While a value of $\alpha=0.96$, will be appropriate for open-loop LPC prediction, for the 16 kb/s LD-CELP coder and for many low noise applications, such a value may yield a "watery" distortion which sounds unnatural and annoying. Thus it proves quite advantageous to increase the value of that the effective length of the recursive window is increased.

If the effective window length of a recursive window is defined to be the time duration from the beginning of the window to the point where the window function value is 10% of its peak value, the recursive window with $\alpha=0.96$ has the peak located around 3.5 ms and an effective window length of roughly 15 ms. A value of $\alpha$ between 0.96 and 0.97 usually gives the highest open-loop prediction gain for 10th-order LPC prediction. However, the watery distortion is a problem when $\alpha=0.96$. With $\alpha$ increased to 0.99, the window peak shifts to approximately 13 ms and the effective window length increased to 61 ms. With such a lengthened window, the watery distortion disappears entirely, but the quality of coded speech can be somewhat degraded. It was found, therefore, that $\alpha=0.985$ is a good compromise, for it gives neither the watery distortion of $\alpha=0.96$ nor the speech quality degradation of $\alpha=0.99$. With $\alpha=0.985$, the window peak occurs at around 8.5 ms, and the effective window length is about 40 ms.

Perceptual Weighting Filter

The perceptual weighting filter used in the illustration 8 kb/s LD-CELP arrangement of FIGS. 3 and 4 is advantageously the same as that used in 16 kb/s LD-CELP described in the cited Chen papers, supra. It has a transfer function of the form $$W(z)=\frac{1-P_2(z/0.9)}{1-P_2(z/0.4)}, \tag{1}$$

where $P_2(z)$ is the transfer function of the 10th-order LPC predictor that is obtained by performing LPC analysis frame-by-frame on the unquantized input speech. This weighting filter de-emphasizes the frequencies where the speech signal has spectral peaks and emphasizes the frequencies where the speech signal has spectral valleys. When this filter is used in closed-loop quantization of excitation, it shapes the spectrum of the coding noise in such a way that the noise become less audible to human ears than the noise that otherwise would have been produced without this weighting filter.

Note that the LPC predictor obtained from the backward LPC analysis is advantageously not used to derive the perceptual weighting filter. This is because the backward LPC analysis is based on the 8 kb/s LD-CELP coded speech, and the coding distortion may cause the LPC spectrum to deviate from the true spectral envelope of the input speech. Since the perceptual weighting filter is used in the encoder only, the decoder does not need to know the perceptual weighting filter used in the encoding process. Therefore, it is possible to use the quantized input speech to derive the coefficients of the perceptual weighting filter, as shown in FIG. 3.

Pitch Prediction

The pitch predictor and its quantization scheme constitute a major part of the illustrative embodiments of a low-bitrate (typically 8 kb/s) LD-CELP coder and decoder shown in FIGS. 3 and 4. Accordingly, the background and operation of the pitch-related functionality of these arrangements will be explained in considerable detail.

Background and Overview

In one embodiment of the pitch predictor 310 of FIG. 3, a backward-adaptive 3-tap pitch predictor of the type described in V. Iyengar and P. Kabal, "A low delay 16 kbits/sec speech coder," *Proc. IEE Int. Conf. Acoust., Speech, Signal Processing*, pp. 243–246 (April 1988) may be used to advantage. However, it proves of further advantage (especially in achieving robustness to channel errors) to modify such a 3-tap backward-adaptive pitch predictor by resetting the pitch parameters whenever unvoiced or silent frames were encountered, generally in accordance with the approach described in R. Petrigrew and V. Cuperman, "Backward adaptation for low delay vector excitation coding of speech at 16 kb/s," Proc. IEEE Global Comm. Conf., pp. 1247–1252 (November 1989). This scheme provides some improvement in the perceived quality of female speech but a less noticeable improvement for male speech. Furthermore, even with frequent resets, the robustness of this scheme to channel errors was still not always satisfactory at BER=$10^{-3}$.

Another embodiment of the pitch predictor 310 of FIG. 3 is based on that described in the paper by Moriya, supra. In that embodiment, a single pitch tap is fully forward transmitted and the pitch period is partially backward and partially forward adapted. Such a technique is, however, sensitive to channel errors.

The preferred embodiment of the pitch predictor 310 in the illustrative arrangement of FIG. 3 has been found to be based on fully forward-adaptive pitch prediction.

In a first variant of such a fully forward-adaptive pitch predictor, a 3-tap pitch predictor is used with the pitch period being closed-loop quantized to 7 bits, and the 3 taps closed-loop vector quantized to 5 or 6 bits. This pitch predictor achieves very high pitch prediction gain (typically 5 to 6 dB in the perceptually weighted signal domain), and it is much more robust to channel errors than the fully or partially backward-adaptive schemes mentioned above. However, with a frame size of either 20 or 32 samples, only 20 or 32 bits are available for each frame. Spending 12 or 13 bits on the pitch predictor left too few bits for excitation coding, especially in the case of a 20-sample frame. Thus alternative embodiments having a reduced encoding rate for the pitch predictor are often desirable.

Since a small frame size is used in the illustrative embodiments of FIGS. 3 and 4, the pitch periods in adjacent frames are highly correlated. Thus, an inter-frame predictive coding scheme is used to advantage to reduce the encoding rate of the pitch period. The challenges in designing such an inter-frame method, however, were:

1. how to make the scheme robust to channel errors,
2. how to quickly track the sudden change in the pitch period when going from a silent or unvoiced region to a voiced region, and
3. how to maintain the high prediction gain in voiced regions.

These challenges are met by a sophisticated 4-bit predictive coding scheme for the pitch period, as will be described more fully in the following. To meet the first challenge, several measures are taken to enhance the robustness of this method against channel errors.

First, a simple first-order, fixed-coefficient predictor is used to predict the pitch period of the current frame from that of the previous frame. This provides better robustness than using a high-order adaptive predictor. By using a "leaky" predictor, it is possible to limit the propagation of channel error effect to a relatively short period of time.

Second, the pitch predictor is turned on only when the current frame is detected to be in a voiced segment of the input speech. That is, whenever the current frame was not voiced speech (e.g. unvoiced or silence between syllables or sentences), the 3-tap pitch predictor 310 in FIGS. 3 and 4 is turned off and reset. The inter-frame predictive coding scheme is also reset for the pitch period. This further limits how long the channel error effect can propagate. Typically the effect is limited to one syllable.

Third, the pitch predictor 310 in accordance with aspects of a preferred embodiment of the present invention uses pseudo Gray coding of the kind described in J. R. B. De Marca and N. S. Jayant, "An algorithm for assigning binary indices to the codevectors of a multi-dimensional quantizer," Proc. IEEE Int. Conf. on Communications, pp. 1128–1132 (June 1987) and K. A. Zeger and A. Gersho, "Zero redundancy channel coding in vector quantization," Electronics Letters 23(12) pp. 654–656 (June 1987). Such pseudo Gray coding is used not only on the excitation codebook, but also on the codebook of the 3 pitch predictor taps. This further improves the robustness to channel errors.

Two steps are taken to meet the second challenge of quickly tracking the sudden change in pitch period when going from unvoiced or silence to voiced frames. The first step is to use a fixed, non-zero "bias" value as the pitch period for unvoiced or silence frames. Traditionally, the output pitch period of a pitch detector is always set to zero except for voiced regions. While this seems natural intuitively, it makes the pitch period contour a non-zero-mean sequence and also makes the frame-to-frame change of the pitch period unnecessarily large at the onset of voiced regions. By using a fixed "bias" of 50 samples as the pitch period for unvoiced and silence frames, such a pitch change at the onset of voiced regions is reduced, thus making it easier for the inter-frame predictive coding scheme to more quickly catch up with the sudden pitch change.

The second step taken to enhance tracking of sudden changes in pitch period is to use large outer levels in the 4-bit quantizer for the inter-frame prediction error of the pitch period. Fifteen quantizer levels located at −20, −6, −5, −4, . . . 4, 5, 6, 20 are used for inter-frame differential coding, and the 16-th level is designated for "absolute" coding of the pitch bias of 50 samples during unvoiced and silence frames. The large quantizer levels −20 and +20 allow quick catch up with the sudden pitch change at the beginning of voice regions, and the more closely spaced inner quantizer levels from −6 to +6 allow tracking of the subsequent slow pitch changes with the same precision as the conventional 7-bit pitch period quantizer. The 16-th "absolute" quantizer level allows the encoder to ten the decoder that the current frame was not voiced; and it also provides a way to instantly reset the pitch period contour to the bias value of 50 samples, without having a decaying trig tail which is typical in conventional predictive coding schemes.

With the introduction of a 50-sample pitch bias and the use of large outer quantizer levels, it was found that at the beginning of voiced regions only 2 to 3 flames (i.e. about 5 to 12 ms) are typically required for the coded pitch period to catch up with the true pitch period. During those initial 2 or 3 frames, because the pitch predictor does not yet provide enough prediction gain, the coded speech has more coding distortion (in the mean-square error sense). However, little or no perceived distortion results from this initial processing, because human ears are less sensitive to coding distortion during signal transition regions.

To meet the third challenge of achieving high prediction gain, the pitch parameter quantization method or scheme in accordance with an aspect of the present invention is arranged so that it performs closed-loop quantization in the context of predictive coding of the pitch period. This scheme works in the following way. First, a pitch detector is used to obtain a pitch estimate for each frame based on the input speech (an open-loop approach). If the current frame is unvoiced or silence, the pitch predictor is turned off and no closed-loop quantization is needed (the 16-th quantizer level is sent in this case). If the current frame is voiced, then the inter-frame prediction error of the pitch period is calculated. If this prediction error has a magnitude greater than 6 samples, this implies that the inter-frame predictive coding scheme is trying to catch up with a large change in the pitch period. In this case, the closed-loop quantization should not be performed since it might interfere with the attempt to catch up with the large pitch change. Instead, direct open-loop quantization using the 15-level quantizer is performed. If, on the other hand, the inter-frame prediction error of the pitch period is not greater than 6 samples, then the current frame is most likely in the steady-state region of a voiced speech segment. Only in this case is closed-loop quantization performed. Since most voiced frames do fall into this category, closed-loop quantization is indeed used in most voiced frames.

Figure 5:
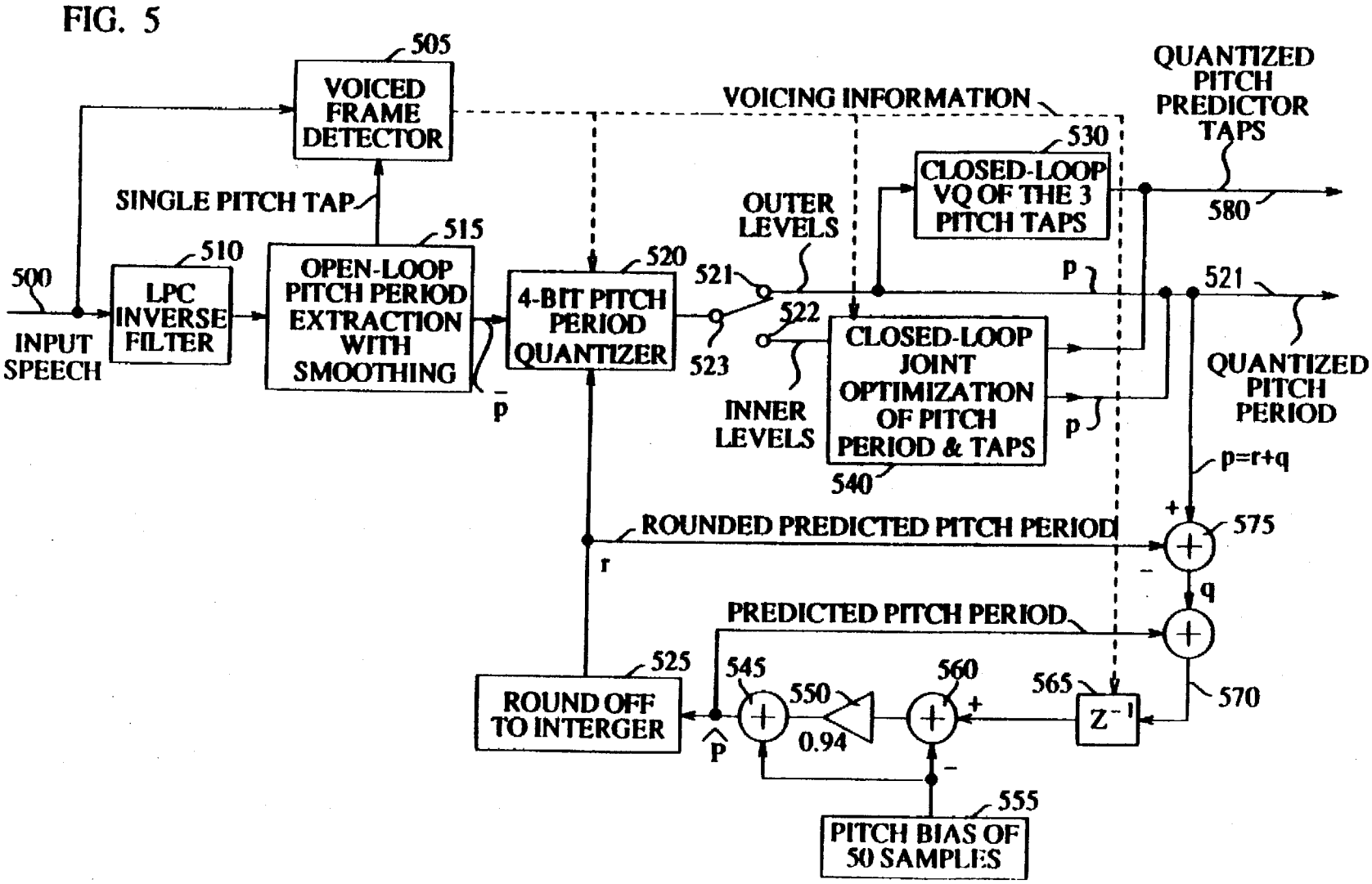
FIG. 5 shows an illustrative embodiment of a pitch predictor, including its quantizer.

Having introduced the basic principles of a preferred embodiment of the pitch predictor (including its quantization scheme) of the present invention for use in the CELP coder and decoder of FIGS. 3 and 4, respectively, each component of the scheme or method will be described in more detail. For this purpose, FIG. 5 shows a block/flow diagram of the quantization scheme of the pitch period and the 3 pitch predictor taps.

Open-Loop Pitch Period Extraction

The first step is to extract the pitch period from the input speech using an open-loop approach. This is accomplished in element 510 of FIG. 5 by first performing 10th-order LPC inverse filtering to obtain the LPC prediction residual signal. The coefficients of the 10th-order LPC inverse filter are updated once a frame by performing LPC analysis on the unquantized input speech. (This same LPC analysis is also used to update the coefficients of the perceptual weighting filter, as shown in FIG. 3.) The resulting LPC prediction residual is the basis for extracting the pitch period in element 515.

There are two challenges in the design of this pitch extraction algorithm:

(1) the computational complexity should be low enough to allow single-DSP real-time implementation of the entire 8 kb/s LD-CELP coder, and (2) the output pitch contour should be smooth (i.e. no multiple pitch periods are allowed), and no extra delay is allowed for the pitch smoothing operation. The reason for (1) is obvious.

The reason for (2) is that the inter-frame predictive coding of the pitch period will be effective only if the pitch contour evolves smoothly in voiced regions of speech.

The pitch extraction algorithm is based on correlation peak picking processing described in the Rabiner and Schafer reference, supra. Such peak picking is especially well suited to DSP implementations. However, implementation efficiencies without sacrifice in performance compared with a straightforward correlation peak picking algorithm for pitch period search can be achieved by combining 4:1 decimation and standard correlation peak picking.

The efficient search for the pitch period is performed in the following way. The open-loop LPC prediction residual samples are first lowpass filtered at 1 kHz with a third-order elliptic filter and then 4:1 decimated. Then, using the resulting decimated signal, the correlation values with time lags from 5 to 35 (corresponding to pitch periods of 20 to 140 samples) are computed, and the lag $\tau$ which gives the largest correlation is identified. Since this time lag $\tau$ is the lag in the 4:1 decimated signal domain, the corresponding time lag which gives the maximum correlation in the original undecimated signal domain should lie between $4\tau-3$ and $4\tau+3$.

To get the original time resolution, the tindecimated LPC prediction residual is then used to compute the correlation values for lags between $4\tau-3$ and $4\tau+3$, and the lag that gives peak correlation is the first pitch period candidate, denoted as $p_0$. Such a pitch period candidate tends to be a multiple of the true pitch period. For example, if the hue pitch period is 30 samples, then the pitch period candidate obtained above is likely to be 30, 60, 90, or even 120 samples. This is a common problem not only to the correlation peak picking approach, but also to many other pitch detection algorithms. A common remedy for this problem is to look at a couple of pitch estimates for the subsequent frames, and perform some smoothing operation before the final pitch estimate of the current frame is determined. However, this inevitably increases the overall system delay by the number of frames buffered before determining the final pitch period of the current frame. This increased delay conflicts with the goal of achieving low coding delay. Therefore, a way was devised to eliminate the multiple pitch period without increasing the delay.

This is accomplished by making use of the fact that estimates of the pitch period are made quite frequently—once every 20 or 32 speech samples. Since the pitch period typically varies between 20 and 140 samples, frequent pitch estimation means that, at the beginning of each speech spurt, the fundamental pitch period will be first obtained before the multiple pitch periods have a chance to show up in the correlation peak-picking process described above. After the initial time, the fundamental pitch period can be locked onto by checking to see if there is any correlation peak in the neighborhood of the pitch period of the previous frame.

Let $\tilde{p}$ be the pitch period of the previous frame. If the first pitch period candidate $p_0$ obtained above is not in the neighborhood of $\tilde{p}$, then the correlation in the undecimated domain for time lags $i=\tilde{p}-6, \tilde{p}-5, \ldots, \tilde{p}+5, \tilde{p}+6$ are also evaluated. Out of these 13 possible time lags, the time lag that gives the largest correlation is the second pitch period candidate, denoted as $p_1$.

Next, one of the two pitch period candidates ($p_0$ or $p_1$) is picked for the final pitch period estimate, denoted as $\bar{p}$. To do this the optimal tap weight of the single-tap pitch predictor with $p_0$ samples of bulk delay is determined, and then the tap weight is clipped between 0 and 1. This is then repeated for the second pitch period candidate $p_1$. If the tap weight corresponding to $p_1$ is greater than 0.4 times the tap weight corresponding to $p_0$, then the second candidate $p_1$ is used as the final pitch estimate; otherwise, the first candidate $p_0$ is used as the final pitch estimate. Such an algorithm does not increase the delay. Although the just-described algorithm represented by element 515 in FIG. 5 is rather simple, it works very well in eliminating multiple pitch periods in voiced regions of speech.

The open-loop estimated pitch period obtained in element 515 in FIG. 5 as described above is passed to the 4-bit pitch period quantizer 520 in FIG. 5. Additionally, the tap weight of the single-tap pitch predictor with $p_0$ samples of bulk delay is provided by element 515 to the voiced frame detector 505 in FIG. 5 as an indicator of waveform periodicity.

Voiced Frame Detector

The purpose of the voiced frame detector 505 in FIG. 5 is to detect the presence of voiced frames (corresponding to vowel regions), so that the pitch predictor can be mined on for those voiced frames and turned off for all other "non-voiced frames" (which include unvoiced, silence, and transition frames). The term "non-voiced frames," as used here, means all frames that are not classified as voiced frames. This is somewhat different from "unvoiced frames", which usually correspond to fricative sounds of speech. See the Rabiner and Schafer reference, supra. The motivation is to enhance robustness by limiting the propagation of channel error effects to within one syllable.

Note that turning the pitch predictor off during non-voiced or silence frames does not cause any noticeable performance degradation, since the pitch prediction gain in those frames is typically close to zero anyway. Also note that it is harmless to occasionally misclassify non-voiced and silence frames as voiced frames, since CELP coders work fine even when the pitch predictor is used in every frame. On the other hand, misclassifying a voice frame as non-voiced in the middle of a steady-state voiced segment could significantly degrade speech quality; therefore, our voiced frame detector was specially designed to avoid this kind of misclassification.

In detecting voiced frames, use is made of an adaptive magnitude threshold, the tap weight of the single-tap pitch predictor (generated by the pitch extraction algorithm), the normalized first-order autocorrelation coefficient, and the zero-crossing rate (in that priority order). If each frame is viewed in isolation and an instantaneous voicing decision is made solely based on that frame, then it is generally quite difficult to avoid the occasional and isolated non-voiced frames in the middle of voiced regions. Turning off the pitch predictor at such frames will cause significant quality degradation.

To avoid this kind of misclassification, the so-called "hang-over" strategy commonly used in the speech activity detectors of Digital Speech Interpolation (DSI) systems was adopted for use in the present context. The hang-over method used can be considered as a post-processing technique which counts the preliminary voiced/non-voiced classifications that are based on the four decision parameters given above. Using hang-over, the detector officially declares a non-voiced frame only if 4 or more consecutive frames have been preliminarily classified as non-voiced. This is an effective method to eliminate isolated non-voiced frames in the middle of voice regions. Such a delayed declaration is applied to non-voiced frames only. (The declaration is delayed, but the coder does not incur any additional buffering delay.) Whenever a frame is preliminarily classified as voiced, that frame is immediately declared as voiced officially, and the hang-over frame counter is reset to zero.

The preliminary classification works as follows. The adaptive magnitude threshold function is a sample-by-sample exponentially decaying function with an illustrative decaying factor of 0.9998. Whenever the magnitude of an input speech sample is greater than the threshold, the threshold is set (or "refreshed") to that magnitude and continue to decay from that value. The sample-by-sample threshold function averaged over the current frame is used as the reference for comparison. If the peak magnitude of the input speech samples within the current frame is greater than 50% of the average threshold, we immediately declare the current frame as voiced. If this peak magnitude of input speech less than 2% of the average threshold, we preliminarily classify the current frame as non-voiced and then such a classification is subject to the hang-over post-processing. If the peak magnitude is in between 2% and 50% of the average threshold, then it is considered to be in the "grey area" and the following three tests are relied on to classify the current frame.

First, if the tap weight of the optimal single-tap pitch predictor of the current frame is greater than 0.5, then we declare the current frame as voiced. If the tap weight is not greater than 0.5, then we test if the normalized first-order autocorrelation coefficient of input speech is greater than 0.4; if so, we declare the current frame as voiced. Otherwise, we further test if the zero-crossing rate is greater than 0.4; if so, we declare the current frame as voiced. If all of the three test fails, then we temporarily classify the current frame as non-voiced, and such a classification then goes through the hang-over post-processing procedure.

This simple voiced frame detector works quite well. Although the procedures may appear to be somewhat complicated, in practice, when compared with other tasks of the 8 kb/s LD-CELP coder, this voiced frame detector takes only a negligible amount of DSP real time to implement In FIG. 5, all function blocks operate normally if the current frame is declared voiced. On the other hand, if the voiced frame detector declares a non-voiced frame, then the following special actions take place. First, the 16th quantizer level of the 4-bit pitch period quantizer (i.e. the absolute coding of the 50-sample pitch bias) is chosen as the quantizer output. Second, a special all-zero codevector from the VQ codebook of the 3 pitch taps is chosen; that is, all three pitch predictor taps are set to zero. (Such special control is shown as dashed lines in FIG. 3.) Third, the memory (delay unit) in the feedback loop in the lower half of FIG. 5 is reset to the value of the fixed pitch bias of 50 samples. Fourth, the pitch predictor memory is reset to zero. In addition, if the current frame is the first non-voiced frame after voiced frames (i.e. at the trailing edge of a voiced region), then speech coder internal states that can reflect channel errors are advantageously reset to their appropriate initial values. All these measures are taken in order to limit the propagation of channel error effect from one voiced region to another, and they indeed help to improve the robustness of the coder against channel errors.

Inter-Frame Predictive Quantization of the Pitch Period

The inter-frame predictive quantization algorithm or scheme for the pitch period includes the 4-bit pitch period quantizer 520 and the prediction feedback loops in the lower half of FIG. 5. The lower of these feedback loops comprises the delay element 565 providing one input to comparator 560 (with the other input coming from the "bias" source 555 providing a pitch bias corresponding to 50 samples), and the amplifier with the typical gain of 0.94 receiving its input from the comparator 550 and providing its output to summer 545. The other input to summer 545 also comes from the bias source 555. The output of the summer 545 is provided to the round off element 525 and is also fed back to summer 570, which latter element provides input to the delay element 565 based additionally on input from the comparator 575 in the outer feedback loop. As indicated, the round off element 525 also provides its input to the 4-bit pitch period quantizer. The functioning of these elements will now be described.

The 4-bit pitch period quantizer 520 first subtracts the rounded predicted pitch period r from $\bar{p}$, the pitch period generated by the open-loop pitch period extractor 515. If the difference value $d=\bar{p}-r$ is greater than 6 or less than −6, then it is quantized directly into one of the four outer levels of the quantizer: −20, −6, 6, or +20, depending on which of these four outer quantizer levels is closest to the difference value d. In this case, as described above, the inter-frame predictive pitch quantizer is trying to catch up with a big change in the pitch period, and closed-loop optimization of the pitch period should not be done, otherwise it may interfere with the quantizer's attempt to catch up with the change. Under these circumstances, the switch at the output port of the 4-bit pitch period quantizer is connected to the upper position 521. Let q denote the quantized version of the difference d, then the quantized pitch period is computed as p=r+q. This quantized pitch period p is then used in the closed-loop vector quantization of the 3 pitch predictor taps.

If, on the other hand, d is in between −6 and +6, then the switch at the output of the 4-bit pitch period quantizer 520 is connected to the lower position 522, and the open-loop extracted pitch period $\bar{p}$ will undergo further closed-loop optimization. The operation of the block 530 in FIG. 5 labeled "closed-loop joint optimization of pitch period & taps" will be described below. One of the two outputs of this block is the final quantized pitch period p after closed-loop optimization.

The feedback loops in FIG. 5 which are used for inter-frame pitch period prediction will now be described. At the first glance, the structure looks quite different from the usual predictive coder structure. There are two reasons for this difference: (1) a 50-sample pitch bias is applied, and (2) unlike most other predictive coding schemes where the predicted signal can take any value, here our predicted pitch period must be rounded off to the nearest integer before it can be used by the rest of the system.

Referring further to FIG. 5, it can be seen that the quantized pitch period can be expressed as p=r+q. Hence, the quantized version of the inter-frame pitch period prediction error (i.e. the difference value mentioned above) can be obtained as q=p−r, as is done in FIG. 5. Then, after adding q to $\hat{p}$, the floating-point version of the predicted pitch period, in summer 570, the floating-point version of the reconstructed pitch period is obtained. The delay unit 565 labeled "$z^{-1}$" makes available to the floating-point reconstructed pitch period of the previous frame, from which is subtracted a fixed pitch bias of 50 samples provided by element 555. The resulting difference is then attenuated by a factor of 0.94, and the result is added to the pitch bias of 50 samples to get the floating-point predicted pitch period $\hat{p}$. This $\hat{p}$ is then rounded off in element 525 to the nearest integer to produce the rounded predicted pitch period r, and this completes the feedback loops.

Note that if the subtraction and addition of the 50-sample pitch bias is ignored, then the lower feedback loop in FIG. 5 reduces to the feedback loop in conventional predictive coders. The purpose of the leakage factor is to make the channel error effects on the decoded pitch period to decay with time. A smaller leakage factor will make the channel error effects decay faster;, however, it will also make the predicted pitch period deviate farther away from the pitch period of the previous frame. This point, and the need for the 50-sample pitch bias is best illustrated by the following example.

Consider the case when the pitch period of a deep male voice is 100 samples for the previous frame and 101 samples for the current frame, and the pitch period is gradually increasing at a rate of +1 samples/frame. If we did not have the 50-sample pitch bias, then the (rounded) predicted pitch period would be r=$\hat{p}$=100×0.94=94, and the inter-frame pitch period prediction error would be d=$\bar{p}$−r=101−94=7. Since d exceeds 6, it would be quantized to q=6, and the quantized pitch period would be p=94+6=100 rather than the desired value of 101. What is worse is that the pitch quantization scheme would not be able to catch up with even the slow pitch increase in the input speech, as it would continue to generate quantized pitch period of 100 samples until the actual pitch period in the input speech reaches 114 samples, at which point the 4-bit quantizer output level of +20 is chosen instead of +6.

Now consider the case when 50-sample pitch bias is in place. Then, the (rounded) predicted pitch period will be r=$\hat{p}$=50+(100−50)×0.94=97, and the inter-frame pitch period prediction error will be d=101−97=4. This is within the quantizer range, so the predictive quantization scheme will be able to keep up with the pitch increase in the input speech.

From this example, it should be clear that the fixed pitch bias is desirable. It should also be clear that if the leakage factor is too small, the pitch period quantization scheme may not be able to keep track of the change in the input pitch period.

Another advantage of the pitch bias is that it allows the pitch quantization scheme to more quickly catch up with the sudden change of the pitch period at the beginning of a voiced region. For example, if the pitch period at the onset of a voiced region is 90 samples, then, without the pitch bias (i.e. the pitch starts from zero), it would take 6 frames to catch up, while with a 50-sample pitch bias, it only takes 2 frames to catch up (by selecting the +20 quantizer level twice).

Closed-Loop Quantization of Pitch Predictor Taps

If the 4-bit pitch period quantizer 520 is in a "catch-up mode", one of its outer quantizer levels will be chosen, and the switch at its output will be connected to the upper position. In this case, no further adjustment of the pitch period is performed, and the quantized pitch period p is used directly in the closed-loop VQ of the 3 pitch predictor taps. The pitch predictor tap vector quantizer quantizes the 3 pitch predictor taps and encodes them into 5 or 6 bits using a VQ codebook of 32 or 64 entries, respectively.

A seemingly natural way of performing such vector quantization is to first compute the optimal set of 3 tap weights by solving a third-order linear equation and then directly vector quantizing the 3 taps using the mean-squared error (MSE) of the 3 taps as the distortion measure. However, since our ultimate goal is to minimize the perceptually weighted coding noise rather than to minimize the MSE of the 3 taps themselves, a better approach is to perform the so-called closed-loop quantization which attempts to minimize the perceptually weighted coding noise directly. Since the quantization of the pitch predictor and the quantization of the excitation signal together can be considered as a two-stage, successive approximation process, minimizing the energy of the weighted pitch prediction residual directly minimizes the overall distortion measure of the entire LD-CELP encoding process. Compared with the straightforward coefficient MSE criterion, this closed-loop quantization not only gives better pitch prediction gain, but also reduces the overall LD-CELP coding distortion. However, the codebook search with this weighted residual energy criterion normally requires much higher computational complexity unless a fast search method is used. In the following, the principles of the fast search method used in the 8 kb/s LD-CELP coder are described.

Let $b_{j1}$, $b_{j2}$, and $b_{j3}$ be the three pitch predictor taps of the j-th entry in the pitch tap VQ codebook.

Then, the corresponding three-tap pitch predictor has a transfer function of $$P_1(z)=\sum_{i=1}^{3} b_{ji}z^{-p+2-i}. \tag{2}$$

where p is the quantized pitch period determined above.

Suppose the frame size is L samples. Without loss of generality, we can index signal samples in the current frame from k=1 to k=L. Non-positive indices corresponds to signal samples in previous frames. Let d(k) be the k-th sample of the excitation to the LPC filter (i.e. the output of the pitch synthesis filter). Then, the k-th output sample of the j-th candidate pitch predictor can be expressed as $$f(k)=\sum_{i=1}^{3} b_{ji}d(k-p+2-i) \tag{3}$$

Now if we define an L-dimensional column vector $$f=[f(1), f(2), \ldots, f(L)]^T,$$

then we have $$f=\sum_{i=1}^{3} b_{ji}d_i \tag{4}$$

where $$d_i=[d(1-p+2-i), d(2-p+2-i), \ldots, d(L-p+2-i)]^T \tag{5}$$

Note that if the pitch period p is smaller than the frame size (in the case of 32-sample frame), then $d_i$ will have some of its components d(k) with an index k>0. That is, it requires some d(k) samples in the current frame. However, these samples are not yet available since the quantization of pitch predictor taps and the excitation are not completed yet. The closed-loop quantization of the single-tap pitch predictor in other conventional CELP coders also has the same problem. This problem can easily be avoided by using the idea of "extended adaptive codebook", as proposed in W. B. Kleijn, D. J. Krasinski, and R. H. Ketchurn, "Improved speech quality and efficient vector quantization in SELP," Proc. IEEE Int. Conf. Acoust., Speech, Signal Processing, (April 1988), Basically, the d(k) sequence is extrapolated for the current frame by periodically repeating the last p samples of d(k) in the previous frame, where p is the pitch period.

Just as in the standard CELP encoding process, before the closed-loop quantization of the 3 pitch taps is started, current frame of input speech is passed through the perceptual weighting filter, and then subtract the zero-input response of the weighted LPC filter from the resulting weighted speech frame. The difference signal t(k) is the target signal for closed-loop quantization of the pitch predictor taps. We can define the L-dimensional target frame to be $$t=[t(1), t(2), \ldots, t(L)]^T.$$

Let h(n) be the impulse response of the cascaded LPC synthesis filter and the perceptual weighting filter (i.e. the weighted LPC filter). Define H to be the L by L lower triangular matrix with the ij-th component given by $h_{ij}=h(i-j)$ for $i\geqq j$ and $h_{ij}=0$ for $i<j$. Then, for the closed-loop pitch tap codebook search, the distortion associated with the j-th candidate pitch predictor in the pitch tap VQ codebook is given by $$D_j=\|t-Hf\|^2=\|t-H\sum_{i=1}^{3} b_{ji}d_i\|^2=\|t-\sum_{i=1}^{3} b_{ji}(Hd_i)\|^2, \tag{6}$$

where for any given vector a, the symbol "$\|a\|^2$" means the square of the Euclidean norm, or the energy, of a.

Now, if we define $$c_i=Hd_i \tag{7}$$

and expand the terms in Eq. (6), then we will have $$D_j=\|t-\sum_{i=1}^{3} b_{ji}c_i\|^2=\|t\|^2-2t^T\sum_{i=1}^{3} b_{ji}c_i+\|\sum_{i=1}^{3} b_{ji}c_i\|^2 \tag{8}$$

$$=\|t\|^2-2\sum_{i=1}^{3} b_{ji}(t^Tc_i)+\sum_{i=1}^{3}\sum_{m=1}^{3} b_{ji}b_{jm}c_i^Tc_m \tag{9}$$

$$=E-2\sum_{i=1}^{3} b_{ji}\phi_i+\sum_{i=1}^{3}\sum_{m=1}^{3} b_{ji}b_{jm}\psi_{im}, \tag{10}$$

where $$E=\|t\|^2, \tag{11}$$

$$\phi_i=t^Tc_i, \tag{12}$$

and $$\psi_{im}=c_i^Tc_m. \tag{13}$$

Expanding the summations in Eq. (10) and collapsing similar terms, we can rewrite Eq. (10) as $$D_j=E-B_j^TC, \tag{14}$$

where $$B_j^T=[2b_{j1}, 2b_{j2}, 2b_{j3}, -2b_{j1}b_{j2}, -2b_{j2}b_{j3}, -2b_{j3}b_{j1}, -b_{j1}^2, -b_{j2}^2, -b_{j3}^2], \tag{15}$$

and $$C=[\phi_1, \phi_2, \phi_3, \psi_{12}, \psi_{23}, \psi_{31}, \psi_{11}, \psi_{22}, \psi_{33}]^T. \tag{16}$$

Since the target vector energy term E is constant during the codebook search, minimizing $D_j$ is equivalent to minimizing $B_j^TC$, the inner product of two 9-dimensional vectors $B_j$ and C. Since the two versions of the 8 kb/s LD-CELP coder use either 5 or 6 bits to quantize the 3 pitch predictor taps, there are either 32 or 64 candidate sets of pitch predictor taps in the pitch tap VQ codebook. For convenience of the following discussion, assume that a 6-bit codebook is being used.

For each of the 64 candidate sets of pitch predictor taps in the codebook, there is a corresponding 9-dimensional vector $B_j$ associated with it. The 64 possible 9-dimensional $B_j$ vectors are advantageously pre-computed and stored, so there is no computation needed for the $B_j$ vectors during the codebook search. Also note that since the vectors $d_1$, $d_2$, and $d_3$ are slightly shifted versions of each other, the C vector can be computed quite efficiently if such a structure is exploited. In the actual codebook search, once the 9-dimensional vector C is computed, the 64 inner products with the 64 stored $B_j$ vectors are calculated, and the $B_{j^*}$ vector which gives the largest inner product is identified. The three quantized predictor taps are then obtained by multiplying the first three elements of this $B_{j^*}$ vector by 0.5. The 6-bit index j* is passed to the output bitstream multiplexer once a frame.

To be able to completely shut off the pitch predictor when the current frame is not a voiced frame, a zero codevector has been inserted in the pitch tap VQ codebook. The other 31 or 63 pitch tap codevectors are closed-loop trained using a codebook design algorithm of the type described in Y. Linde, A. Buzo and R. M. Gray, "An algorithm for vector quantizer design", *IEEE Trans. Comm.*, Comm. 28, pp. 84–95 (January 1980). Whenever the voiced frame detector declares a non-voiced frame, we not only reset the pitch period to the bias value of 50 samples but also select this all-zero codevector as the pitch tap VQ output. That is, all three pitch taps are quantized to zero. Hence, both the 4-bit pitch period index and the 5 or 6-bit pitch tap index can be used as indicators of a non-voiced frame. Since mistakenly decoding voiced frames as non-voiced in the middle of voiced regions generally causes the most severe speech quality degradation, that kind of error should be avoided where possible. Therefore, at the decoder, the current frame is declared to be non-voiced only if both the 4-bit pitch period index and the 5 or 6-bit pitch tap index indicate that it is non-voiced. Using both indices as non-voiced frame indicator provides a type of redundancy to protect against voiced to non-voiced decoding errors.

So far the functionality represented by the block 530 labeled "closed-loop VQ of the 3 pitch taps" in FIG. 5 has been described for those cases where the inter-frame pitch period prediction error has a magnitude greater than 6 samples. Next, the case when the magnitude of such pitch period prediction error is less than or equal to 6 samples will be described. In these cases, the opportunity exists to do finer adjustment of the pitch period with the hope to find a better pitch period in the closed-loop sense. Thus, the switch 523 at the output of the 4-bit pitch quantizer is positioned at the lower position 522 to permit the closed-loop joint optimization of pitch period and taps.

Ideally, the best closed-loop quantization performance can be obtained upon a search through all possible combinations of the 13 pitch quantizer levels (from −6 to +6) and the 32 or 64 codevectors of the 3-tap VQ codebook. However, the computational complexity of such an exhaustive joint search may be too high for real time implementation. Hence, it proves advantageous to seek simpler sub-optimal approaches.

A first embodiment of such approach that may be used in some applications of the present invention involves first performing closed-loop optimization of the pitch period using the same approach as conventional CELP coders (based on single-tap pitch predictor formulation). Suppose the resulting closed-loop optimized pitch period was p*. Then, three separate closed-loop pitch tap codebook search are performed with the fast search method described above and with the three possible pitch period p*−1, p*, and p*+1 (subject to the quantizer range constraint of [r−6, r+6], of course). This approach gave very high pitch prediction gains, but may still involve a complexity that cannot be tolerated in some applications.

In a second preferred approach, to reducing computational complexity, the closed-loop quantization of the pitch period are skipped, but 5 candidate pitch periods are allowed while performing closed-loop quantization of the 3 pitch taps. The 5 candidate pitch periods were $\bar{p}-2$, $\bar{p}-1$, $\bar{p}$, $\bar{p}+1$, and $\bar{p}+2$ (still subject to the range constraint of [r−6, r+6]), where $\bar{p}$ was the pitch period obtained by the open-loop pitch extraction algorithm. This was equivalent to jointly quantizing the pitch period and the pitch taps in a closed-loop manner with a reduced pitch quantizer range (5 candidates of the pitch period rather than 13). The prediction gain obtained by this simpler approach was comparable to that of the first approach.

Pitch Predictor Performance

With the sophisticated inter-frame pitch parameter quantization scheme described above, we could achieve roughly the same pitch prediction gain (5 to 6 dB in the perceptually weighted signal domain) as our initial scheme with 7-bit pitch period and 5 or 6-bit pitch taps. Furthermore, our informal listening indicated that under noisy channel conditions, we obtained quite comparable speech quality whether we used the conventional 7-bit pitch quantizer or our 4-bit inter-frame predictive quantizer. In other words, we have reduced the pitch period encoding rate from 7 bits/frame to 4 bits/frame without compromising either the pitch prediction gain or the robustness to channel errors. This 3 bits saving may appear insignificant, but with our small frame sizes, they account for roughly 10 to 15% of the total bit-rate (or 750 to 1200 bps). We found that after allocating these 3 bits to excitation coding, the perceptual quality of coded speech was improved significantly.

Gain Adaptation

The excitation gain adaptation scheme is essentially the same as in the 16 kb/s LD-CELP algorithm. See, J.-H. Chen, "High-quality 16 kb/s low-delay CELP speech coding with a one-way delay less than 2 ms." *Proc. IEEE Int. Conf. Acoust., Speech, Signal Processing*, pp. 181–184 (April 1990). The excitation gain is backward-adapted by a 10th-order linear predictor operated in the logarithmic gain domain. The coefficients of this 10th-order log-gain predictor are updated once a frame by performing backward-adaptive LPC analysis on previous logarithmic gains of scaled excitation vectors.

Excitation Coding

Table 1 below shows the frame sizes, excitation vector dimensions, and bit allocation of two 8 kb/s LD-CELP coder versions and a 6.4 kb/s LD-CELP coder in accordance with illustrative embodiments of the present invention. In the 8 kb/s version with a frame size of 20 samples, each frame contains one excitation vector. On the other hand, the 32-sample frame version has two excitation vectors in each frame. The 6.4 kb/s LD-CELP coder is obtained by simply increasing the frame size and the vector dimension of the 32-sample frame version and keeping everything else the same. In all three coders, we spend 7 bits on the excitation shape codebook, 3 bits on the magnitude codebook, and 1 bit on the sign for each excitation vector.

TABLE 1

LD-CELP coder parameters and bit allocation

| Bit-rate | 8 kb/s | 8 kb/s | 6.4 kb/s |
|---|---|---|---|
| Frame size (ms) | 2.5 | 4 | 5 |
| Frame size (samples) | 20 | 32 | 40 |
| Vector dimension | 20 | 16 | 20 |
| Vectors/frame | 1 | 2 | 2 |
| Pitch period (bits) | 4 | 4 | 4 |
| Pitch taps (bits) | 5 | 6 | 6 |
| Excitation sign (bit) | 1 | 1 × 2 | 1 × 2 |
| Excitation magnitude (bits) | 3 | 3 × 2 | 3 × 2 |
| Excitation shape (bits) | 7 | 7 × 2 | 7 × 2 |
| Total bits/frame | 20 | 32 | 32 |

The excitation codebook search procedure or method used in these illustrative embodiments is somewhat different from the codebook search in 16 kb/s LD-CELP. Since the vector dimension and gain codebook size at 8 kb/s are larger, and the same codebook search procedure used as was used in the earlier 16 kb/s LD-CELP methods described in the cited Chen papers, then the computational complexity would be so high that it would not be feasible to have a full-duplex coder implemented on particular hardware implementations, e.g. a single 80 ns AT&T DSP32C chip. Therefore, it proves advantageous to reduce the codebook search complexity.

There are two major differences between the codebook search methods of the 8 kb/s and 16 kb/s LD-CELP coders.

First, rather than jointly optimizing the excitation shape and gain as in the 16 kb/s coder, it proves advantageous to sequentially optimize the shape and then the gain at 8 kb/s in order to reduce complexity. Second, the 16 kb/s coder directly calculates the energy of filtered shape codevectors (sometimes called the "codebook energy"), while the 8 kb/s coder uses a novel method that is much faster. In the following, the codebook search procedure will be described first, followed by a description of the fast method for calculating the codebook energy.

Excitation Codebook Search Procedure

Before the start of the excitation codebook search, the contribution of the 3-tap pitch predictor is subtracted from the target frame for pitch predictor quantization. The result is the target vector for excitation vector quantization. It is calculated as $$x(n) = t - \sum_{i=1}^{3} b_j * c_j, \tag{17}$$

where all symbols on the right-hand side of the equation are defined in the section entitled "Closed-Loop Quantization of Pitch Predictor Taps" above. For clarity in later discussion, here a vector time index n has been added to the excitation target vector x(n).

In the 20-sample frame version of the 8 kb/s LD-CELP coder, the excitation vector dimension is the same as the frame size, and the excitation target vector x(n) can be directly used in the excitation codebook search. On the other hand, if each frame contains more than one excitation vector (as in the second and third column of Table 1), then the calculation of excitation target vector is more complicated. In this case, we first use Eq. (17) to calculate an excitation target frame. Then, the first excitation target vector is sample-by-sample identical to the corresponding part of the excitation target frame. However, from the second vector on, when calculating the m-th excitation target vector, the zero-input response of the weighted LPC filter due to excitation vector 1 through excitation vector (n−1) must be subtracted from the excitation target frame. This is done in order to separate the memory effect of the weighted LPC filter so that the filtering of excitation codevectors can be done by convolution with the impulse response of the weighted LPC filter. For convenience, the symbol x(n) will still be used to denote the final target vector for the n-th excitation vector.

Let $y_j$ be the j-th codevector in the 7-bit shape codebook, and let $\sigma(n)$ be the excitation gain estimated by the backward gain adaptation scheme. The 3-bit magnitude codebook and the 1 sign bit can be combined to give a 4-bit "gain codebook" (with both positive and negative gains). Let $g_i$ be the i-th gain level in the 4-bit gain codebook. The scaled excitation vector e (n) corresponding to excitation codebook index pair (i, j) can be expressed as $$e(n)=\sigma(n)g_i y_j \tag{18}$$

The distortion corresponding to the index pair (i, j) is given by $$D=\|x(n)-He(n)\|^2=\sigma^2(n)\|\hat{x}(n)-g_i Hy_j\|^2, \tag{19}$$

where $\hat{x}(n)=x(n)/\sigma(n)$ is the gain-normalized excitation VQ target vector. For convenience, the symbol H has been used here again to denote the lower triangular matrix with sub-diagonals populated by samples of the impulse response of the weighted LPC filter. This matrix has exactly the same form as the H matrix in Sec. 6.5, except that now its size is K by K rather than L by L, where K is the excitation vector dimension (K≦L, L/K=a positive integer). Expanding the terms in Eq. (19), we have $$D=\sigma^2(n)[\|\hat{x}(n)\|^2-2g_i\hat{x}^T(n)Hy_j+g_i^2\|Hy_j\|^2]. \tag{20}$$

Since the term $\|\hat{x}(n)\|^2$ and the value of $\sigma^2(n)$ are fixed during the codebook search, minimizing D is equivalent to minimizing $$\hat{D}=-2g_i p^T(n)y_j+g_i^2E_j, \tag{21}$$

where $$p(n)=H^T\hat{x}(n), \tag{22}$$

and $$E_j\|Hy_j\|^2. \tag{23}$$

Note that $E_j$ is actually the energy of the j-th filtered shape codevectors and does not depend on the VQ target vector $\hat{x}(n)$. Also note that the shape codevector $y_j$ is fixed, and the matrix H only depends on the LPC filter and the weighting filter, which are fixed over each frame. Consequently, $E_j$ is also fixed over each frame. Therefore, as long as each frame contains more than one excitation vector, we can save computation by computing and storing the 128 possible energy terms $E_j$, j=0, 1, 2, . . . , 127 at the beginning of each frame, then using these energy terms repeatedly for all vectors in the frame.

By defining $$P_j=p^T(n)y_j, \tag{24}$$

the expression of $\hat{D}$ can be further simplified as $$\hat{D}=-2g_iP_j+g_i^2E_j. \tag{25}$$

In the codebook search of 16 kb/s LD-CELP, all possible combinations of the two indices i and j are searched to find the index combination that minimizes $\hat{D}$ in Eq. (25). However, since the gain codebook size of the 8 kb/s coder is twice as large as that of the 16 kb/s coder, performing such a joint optimization of shape and gain at 8 kb/s will increase the search complexity considerably. Thus, it proves advantageous to use another suboptimal approach to reduce complexity by searching for the best shape codevector first, and then determine the best gain level for the already selected shape codevector. In fact, this approach is used by most other conventional forward-adaptive CELP coders. In this well-known approach, we first assume that the gain $g_i$ is "floating" and can have any value (i.e. we first assume an unquantized gain). Then, by setting $\partial\hat{D}/\partial g_i=0$, we can obtain the optimal unquantized excitation gain as $$g_i^*=\frac{P_j}{E_j}. \tag{26}$$

Substituting $g_i=g_i^*$ in Eq. (25) yields $$\hat{D}=-\frac{P_j^2}{E_j}. \tag{27}$$

Therefore, the best shape codebook index is determined by finding the index j that maximizes $P_j^2/E$. Given the selected best shape codebook index j, it can be shown that the corresponding best gain index can be found by directly quantizing the optimal gain $g_i^*$ using the 4-bit gain codebook. Because the gain quantization is out of the shape codebook search loop, the search complexity is reduced significantly. Once the best shape codebook index and the corresponding gain codebook index are identified, we then concatenate these two indices together to form a single 11-bit codeword and pass this codeword to the output bitstream multiplexer.

It can be shown that if all 128 filtered (or convolved) codevectors $Hy_j$, j=0, 1, 2, . . . , 127 have the same Euclidean norm, then the sequential optimization outlines above will give identical output indices i and j as the joint optimization search method. In reality, since the matrix H is time-varying, the $Hy_j$ vectors do not have the same norm in general. A close approximation to this condition can be achieved by requiring that the 128 fixed $y_j$ codevectors have the same norm. Therefore, after the closed-loop design of the excitation shape codebook, codevector is normalized so that all of them have unity Euclidean norm. Such a normalization procedure does not cause noticeable degradation in coding performance.

It has been noted by other researchers that when using this sequential optimization approach rather then the joint optimization approach in conventional CELP coders, there is no noticeable performance degradation as long as the excitation gain quantization has sufficient resolution. In the earlier 16 kb/s LD-CELP, it was found that with a 2-bit magnitude codebook, there could be significant degradation if the sequential optimization had been used. Hence, joint optimization of shape and gain is indeed needed there. On the other hand, in the 8 kb/s LD-CELP coder, with the 3-bit magnitude codebook providing more resolution in gain quantization, it has been found that the relative degradation due to the sequential optimization was so small that it was essentially negligible.

Codebook Energy Calculation

With the principles of the excitation codebook search reviewed above, the calculating of the energy $E_j$ for j=0, 1, 2 . . . . 127 will be described. Direct calculation of $E_j$ involves the matrix-vector multiplication $Hy_j$ followed by the energy calculation of the resulting K-dimensional vector. The total number of multiplication operations required for calculating all 128 $E_j$ terms is 128×[K(K+1)/2+K]. Thus, the computational complexity essentially grows quadratically with the excitation vector dimension K.

In the 16 kb/s LD-CELP coder, the vector dimension is so low (only 5 samples) that these energy terms directly can be calculated directly. However, in the LD-CELP coders at 8 kb/s and below, the lowest vector dimension we used is 16 (see Table 1). With such a vector dimension, the direct calculation of the codebook energy alone would have taken about 4.8 million instructions per second (MIPS) to implement on an AT&T DSP32C chip. With the codebook search and all other tasks in the encoder and decoder counted, the corresponding total DSP processing power needed for a full-duplex coder could exceed the 12.5 MIPS available on such an 80 ns DSP32C. Thus, it proves desirable to reduce the complexity of the codebook energy calculation.

In the CELP coding literature, several techniques have been proposed to reduce the complexity of the codebook search and codebook energy calculation. (See W. B. Kleijn, D. J. Krasinski, and R. H. Ketchurn, "Fast methods for the CELP speech coding algorithm," *IEEE Trans. Acoust., Speech, Signal Processing,* ASSP-38 (8) pp. 1330–1342 (August 1990) for a comprehensive review of these techniques.) However, a large number of these techniques rely on special structures built into the excitation shape codebook in order to realize complexity reduction. These techniques are clearly not suitable for LD-CELP, because it is very important for LD-CELP to use a closed-loop trained excitation shape codebook*, and since the codebook is trained by iterative algorithm, it has no special structure. (It should be noted that backward-adaptive LPC predictor, although more appropriate for low-delay coding, may be less efficient in removing the redundancy in speech waveforms than the forward-adaptive LPC predictors in conventional CELP coders. As a result, the excitation coding may have a larger burden of quantizing the excitation to the desired accuracy; therefore, a well-trained codebook can be crucial to the overall performance of LD-CELP coders.)

There are only a few complexity reduction techniques available for unstructured codebooks. Most of them either provide insufficient complexity reduction or require a huge amount of storage. One exception is the autocorrelation approach described in I. M. Trancoso and B. S. Atal, "Efficient procedures for finding the optimum innovation in stochastic coders," *Proc. IEEE Int. Conf. Acoust., Speec, Signal Processing,* pp. 2375–2379 (1986), which has only a moderate increase in storage requirement and is computationally quite efficient.

This autocorrelation approach works as follows. Assume that the vector dimension K is large enough so that {h(k)}, the impulse response sequence of the weighted LPC filter, decays to nearly zero as k approaches K. (This assumption is roughly valid for conventional CELP coders where K is 40 or larger.) Then, the energy term $E_j$ can be approximated as $$E_j = \|Hy_j\|^2 \approx \mu_0 v_{j0} + 2\sum_{i=1}^{K-1} \mu_i v_{ji} = \hat{E}_j, \tag{28}$$

where $\mu_i$ is the i-th autocorrelation coefficient of the impulse response vector $[h(0), h(1), \ldots, h(K-1)]^T$, calculated as $$\mu_i = \sum_{k=0}^{K-1-i} h(k)h(k+i), \tag{29}$$

and $V_{ji}$ is the i-th autocorrelation coefficient of the j-th shape codevector $y_j$, calculated as $$v_{ji} = \sum_{k=0}^{K-1-i} y_j(k)y_j(k+i), \tag{30}$$

where $y_j(k)$ is the k-th component of $y_j$. Thus, if we precompute and store the 128 K-dimensional vectors $$v_j=[v_{j0}, 2v_{j1}, 2v_{j2}, \ldots, 2v_{j,K-1}]^T, j=0, 1, 2, \ldots, 127, \tag{31}$$

then, during the actual encoding, we can first compute the K-dimensional vector $$m=[\mu_0, \mu_1, \mu_2, \ldots, \mu_{K-1}]^T, \tag{32}$$

using K(K+1)/2 multiplications, and then compute the 128 approximated codebook energy terms as $$\hat{E}_j=m^T v_j, j=0, 1, 2, \ldots, 127. \tag{33}$$

using 128×K multiplications. The total number of multiplications in this approach is only 128[K+K(K+1)/256], which roughly grows linearly with the vector dimension K (as opposed to quadratically with direct calculation). The price paid is double the codebook storage requirement, since now we need to store two tables, one for the shape codebook itself, and the other for the 128 autocorrelation vectors $v_j$, j=0, 1.

This increase in storage requirement is tolerable in typical 8 kb/s LD-CELP implementation. Thus, this approach can be used to reduce the complexity of codebook energy calculation from the illustrative level of 4.8 MIPS to 0.61 MIPS. After applying this approach, it is possible to implement a full-duplex coder on a single AT&T DSP32C chip. Although this approach works well most of the time in typical embodiments, occasionally the approximation of the energy terms may not be satisfactory. When this occurs, the excitation codebook search can be misled and might pick a poor candidate shape codevector. The net result is a is an occasional, but rare, degraded syllable in the output coded speech. The reason for this problem appears to be that a vector dimension K of only 16 or 20 may not be large enough in all cases for h(k) to decay to nearly zero as k approaches K.

To combat this problem, a new way was devised to calculate the codebook energy. The basic idea is that although it may not be possible to have control over the impulse response sequence, a priori knowledge about each of the 128 fixed shape codevectors $y_j$, j=0, 1, 2, . . . , 127 does exist; thus, they can be dealt with beforehand. To understand this approach, consider the expression $E_j=\|Hy_j\|^2$. The K-dimensional vector $Hy_j$ is basically the first K output samples of a convolution operation between the two K-dimensional vectors $y_j$ and $h=[h(0), h(1), h(2), \ldots, h(K-1)]^T$. Since convolution is a commutative operation, rather than writing $E_j=\|Hy_j\|^2$, $E_j$ can be expressed as $$E_j=\|Y_jh\|^2, \tag{34}$$

where $Y_j$ is a K by K lower triangular matrix with the mn-th component equal to $y_j(m-n)$ for $m\geqq n$ and 0 for $m<n$. This is tantamount to having a "codevector" of h and 128 possible "impulse response vectors" of $y_j$, j=0, 1, 2, . . . 127. Therefore, the autocorrelation approach (the right-hand side of Eq. (28)) produces a very good approximation of the energy term for those $y_j$ vectors that have small components toward the end of the vector. On the other hand, those $y_j$ vectors with smaller components near the beginning and larger components toward the end of the vector always tend to give rise to a poor energy approximation, no matter what the actual impulse response vector h is. These "trouble-making" codevectors will be referred to as the "critical" codevectors as illustrated in FIG. 9A. Non-critical codevectors are illustrated in FIG. 9B". 4. APPROVED DRAWING DESCRIPTION: A new FIG. 9 is required to illustrate critical and non-critical codebook vectors. FIG. 9A will illustrate critical shape(s) such as that described on page 35. FIG. 9B will illustrate non-critical shape(s). The trick is to identify these critical codevectors from the codebook and obtain the corresponding energy terms by exact calculation.

It is not an easy task to find a good criterion for differentiating the critical codevectors from the rest, because the energy approximation error depends on the shape of the time-varying impulse response vector h. The following statistical approach was advantageously adopted. The energy approximation error (in dB) is defined as $$\Delta_j=10\log_{10}\frac{\hat{E}_j}{E_j}, \tag{35}$$

where $\hat{E}_j$ and $E_j$ are defined in Eq. (28).

Given a shape codevector $y_j$, the corresponding energy approximation error $\Delta_j$ depends solely on the impulse response vector h. In actual LD-CELP coding, the vector h varies from frame to frame, so $\Delta_j$ also changes from frame to frame. Therefore, $\Delta_j$ is treated as a random variable, and then estimated its mean and standard deviation as follows. The 8 kb/s LD-CELP coder is used to encode a very large speech file (a training set), and along the way calculated $\Delta_j$, j=0, 1, . . . , 127 was calculated for each frame and also accumulated the summations of $\Delta_j$ and $\Delta_j^2$ across frames for each j. Suppose there are N frames in the training set, and let $\Delta_j(n)$ be the value of $\Delta_j$ at the n-th frame. Then, after encoding the training set, the mean (or expected value) of $\Delta_j$ is easily obtained as $$E[\Delta_j]=\frac{1}{N}\sum_{n=1}^{N}\Delta_j(n), \tag{36}$$

and the standard deviation of $\Delta_j$ is given by $$\sigma_{\Delta_j}=\frac{1}{N}\sum_{n=1}^{N}\Delta_j^2(n)-[E[\Delta_j]]^2 \tag{37}$$

Note that once the mean value of $\Delta_j$ is available, the energy approximation error of the autocorrelation approach can be reduced. It can be shown that the approximated codebook energy term $\hat{E}_j$ produced by the autocorrelation approach is always an over-estimate of the true energy $E_j$. (That is, $\Delta_j\geqq 0$.) In other words, $\hat{E}_j$ is a biased estimate of $E_j$. If $\hat{E}_j$ is multiplied by $10^{-E[\Delta_j]/10}$ (which is equivalent to subtracting $E[\Delta_j]$ from the dB value of $\hat{E}_j$), then the resulting value becomes a unbiassed estimate of $E_j$, and the energy approximation error is reduced.

If a given $\Delta_j$ has a small standard deviation, then it is considered highly predictable, and its mean value can be used as the best estimate for its actual value in any particular frame. On the other hand, if a $\Delta_j$ has relatively large standard deviation, then it is much less predictable, and using its mean value as the estimate will still give a large average estimation error. Therefore, those codevectors $y_j$ that have a large standard deviation of $\Delta_j$ are considered "trouble-makers", because even with the help of the mean value of $\Delta_j$, those critical codevectors still give rise to large energy approximation errors. Thus, it makes sense to use the standard deviation of $\Delta_j$ as the criterion for identifying critical codevectors.

Figure 6:
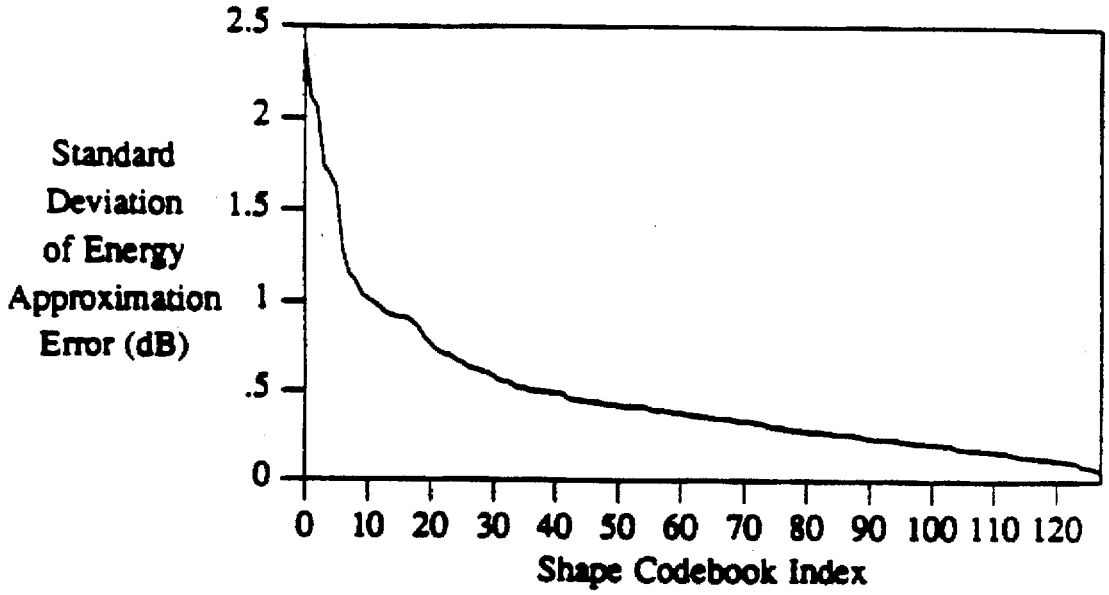
FIG. 6 shows the standard deviation of energy approximation error for an illustrative codebook.
Figure 7:
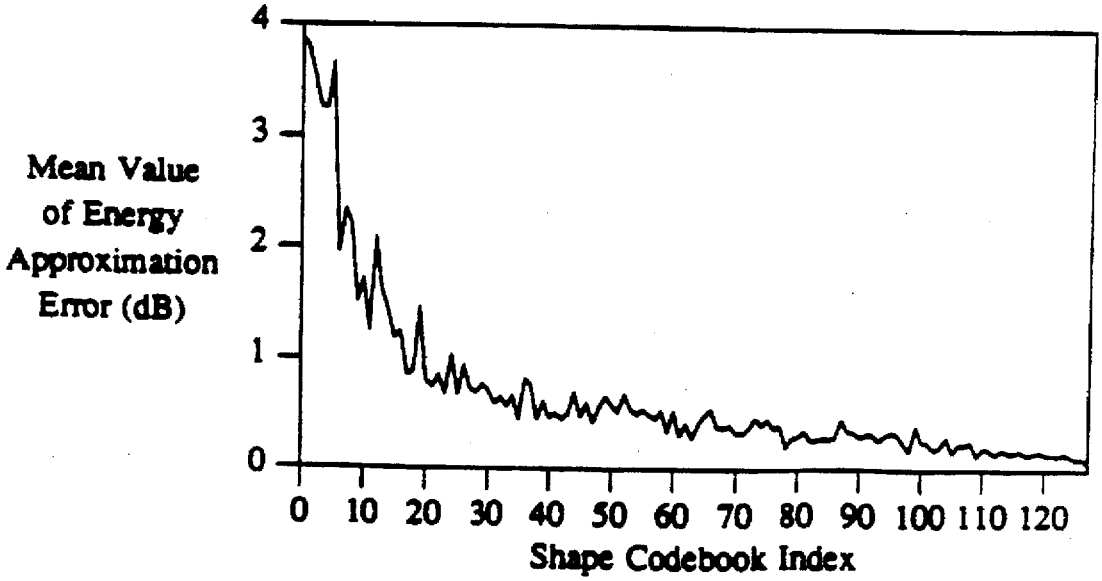
FIG. 7 shows the mean value of energy approximation error for an illustrative codebook.

Even if these critical codevectors are identified, if they are scattered around the codebook, there will be significant overhead in trying to give them special treatment as we step through the codebook. Hence, it is desirable to have all of them placed at the beginning of the codebook. To achieve this, a sorting is performed based on the standard deviation of $\Delta_j$, and permuted the excitation shape codevectors so that the standard deviation of $\Delta_j$ was decreasing with the increasing index j. The mean value of $\Delta_j$ is also permuted accordingly. FIGS. 6 and 7, respectively, show the standard deviation and mean of $\Delta_j$ after the sorting and permutation.

As can be seen from FIGS. 6 and 7, once the codebook has been permuted, then all the critical codevectors are placed at the beginning of the codebook. Suppose a typical real-time implementation allows the performance of the exact energy calculation for the first M cedevectors, then the energy calculation procedure goes as follows.

1. Use the equation $E_j=\|Hy_j\|^2$ to calculate the exact value of $E_j$ for j=0, 1, 2, . . . M.
2. Use the autocorrelation approach of Trancoso and Atal, supra, to calculate a preliminary estimate of energy $$\hat{E}_j=\mu_0v_{j0}+2\sum_{i=1}^{K-1}\mu_iv_{ji}$$

for j=M+1, M+2, . . . 127.

3. Correct the estimation bias in $\hat{E}_j$ and calculate the final energy estimate $E_j^*=\hat{E}_j[10^{-E[\Delta_j]/10}]$ for j=M+1, M+2, . . . , 127.

note that the 128-M terms of $10^{-E[\Delta_j]/10}$ can be precomputed and stored in a table to save computation.

It has been found that with M as small as 10 for a cedebook size of 128, all those rare events of degraded syllables were avoided completely. In an illustrative implementation, M=16, or an eighth of the cedebook size is used. From FIG. 4, it can be seen that for M>16, the standard deviation of energy approximation error is within 1 dB.

In terms of computational complexity, the exact energy calculation of the first 16 cedevectors (the critical ones) illustratively takes about 0.6 MIPS, while the unbiased autocorrelation approach for the other 112 codevectors illustratively takes about 0.57 MIPS. Thus, the total complexity for codebook energy calculation is been reduced from the original 4.8 MIPS to 1.17 MIPS—a reduction by a factor of 4.

One advantage of the above-described energy calculation approach is that it is easily scalable in the sense that M can be chosen to be anywhere between 10 and 128, depending on how much DSP processor real time is left after the DSP software development is completed. For example, if an initial value of M=16 is chosen, but a real-time implementation provides some unused processor time, then M can be increased to 32 to get more codebook energy terms calculated exactly without running out of real time.

Figure 8:
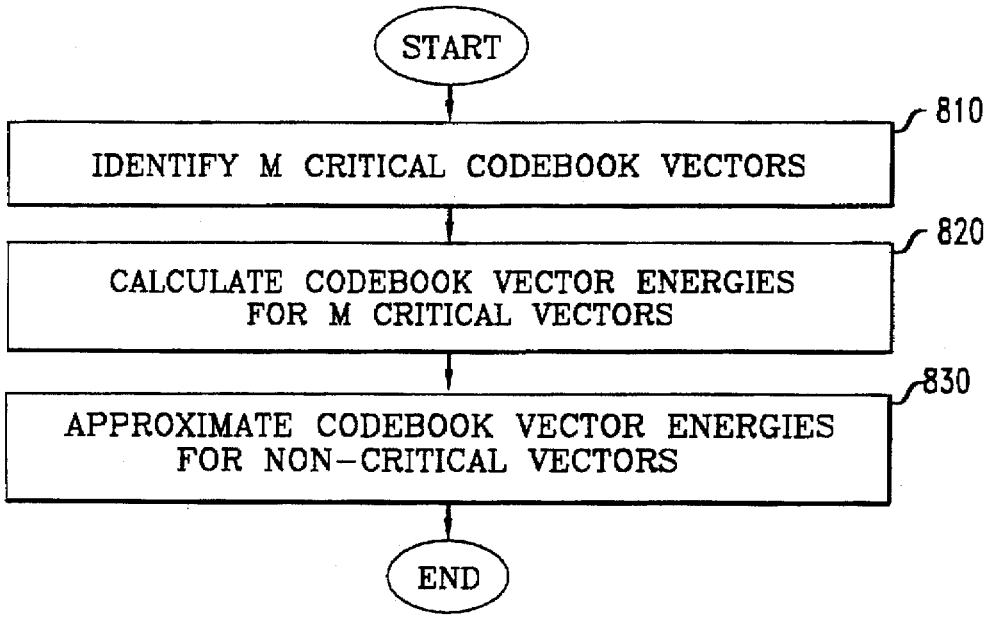
FIG. 8 shows a flow diagram of a method for calculating codebook vector energies in accordance with an illustrative embodiment of the present invention.

FIG. 8 shows a flow diagram of a method for calculating codebook vector energies in accordance with an illustrative embodiment of the present invention. Specifically, as shown in step 810, a set of M critical codebook vectors is identified. These M codebook vectors may, for example, be selected based on a set of standard deviations of a set of energy approximations, as described above. Next, the exact codebook vector energies for these M identified codebook vectors are calculated in step 820. These may be calculated in a conventional manner. And finally, as shown in step 830, approximate codebook vector energies are calculated for the remaining (i.e., the non-critical) codebook vectors. These approximate values may, for example, be determined based on an autocorrelation analysis, such as that described above.

Postfilter

Just as in most conventional CELP coders, the 8 kb/s LD-CELP decoder in accordance with an illustrative embodiment of the present invention advantageously uses a postfilter to enhance the speech quality as indicated in FIG. 4. The postfilter advantageously comprises a long-term postfilter followed by a short-term postfilter and an output gain control stage. The short-term postfilter and the output gain control stage are essentially similar to the ones proposed in the paper of Chen and Gersho cited above, except that the gain control stage advantageously may include additional feature of non-linear scaling for improving the idle channel performance. The long-term postfilter, on the other hand, is of the type described in the Chen dissertation cited above.

One point worth noting is that if the quantized pitch period is determined in the encoder by the closed-loop joint optimization of the pitch period and the pitch taps, then the decoded pitch period may be different from the true pitch period. This is because the closed-loop joint optimization allows the quantized pitch period to deviate from the open-loop extracted pitch period by 1 or 2 samples, and very often such deviated pitch period indeed get selected simply because when combined with a certain set of pitch predictor taps from the tap codebook, it gives the overall lowest perceptually weighted distortion. However, this creates a problem for the postfilter at the decoder, since the long-term postfilter needs a smooth contour of the true pitch period to work effectively. This problem is solved by performing an additional search for the true pitch period at the decoder. The range of the search is confined to within two samples of the decoded pitch period. The time lag that gives the largest correlation of the decoded speech is picked as the pitch period used in the long-term postfilter. This simple method is sufficient to restore the desired smooth contour of the true pitch period.

As can be seen from the Table 4 in the below, the postfilter only takes a very small amount of computation to implement. However, it gives noticeable improvement in the perceptual quality of output speech.

Real-Time Implementation

Tables 2, 3 and 4 below illustrate certain organizational and computational aspects of a typical real-time, full-duplex 8 kb/s LD-CELP coder implementation constructed in accordance with aspects of the present invention using a single 80 ns AT&T DSP32C processor. This version was implemented with a frame size of 32 sample (4 ms).

Table 2 below shows the processor time and memory usage of this implementation.

TABLE 2

DSP32C processor time and memory usage of 8 kb/s LD-CELP

| Implementation mode | Processor time (% DSP32C) | Program ROM (kbytes) | Data ROM (kbytes) | Data RAM (kbytes) | Total memory (kbytes) |
|---|---|---|---|---|---|
| Encoder only | 80.1% | 8.44 | 20.09 | 6.77 | 35.29 |
| Decoder only | 12.4% | 3.34 | 11.03 | 3.49 | 17.86 |
| Encoder + Decoder | 92.5% | 10.50 | 20.28 | 10.12 | 40.91 |

In this illustrative implementation, the encoder takes 80.1% of the DSP32C processor time, while the decoder takes only 12.4%. A full-duplex coder requires 40.91 kbytes (or about 10 kwords) of memory. This count includes the 1.5 kwords of RAM on the DSP32C chip. Note that this number is significantly lower than the sum of the memory requirements for separate half-duplex encoder and decoder. This is because the encoder and the decoder can share some memory when they are implemented on the same DSP32C chip.

Table 3 shows the computational complexity of different parts of the illustrative 8 kb/s LD-CELP encoder. Table 4 is a similar table for the decoder. The complexity of certain parts of the coder (e.g. pitch predictor quantization) varies from frame to frame. The complexity shown on Tables 3 and 4 corresponds to the worst-case number (i.e. the highest possible number). In the encoder, the closed-loop joint quantization of the pitch period and taps, which takes 22.5% of the DSP32C processor time, is the most computationally intensive operation, but it is also an important operation for achieving good speech quality.

TABLE 3

Computational complexity of different tasks in the 8 kb/s LD-CELP encoder.

| Tasks | | | | times | | |
|---|---|---|---|---|---|---|
| | instructions | per 4 ms | No. of DSP32C | (80 ns) | MIPS | % DSP32C |
| LPC analysis | Synthesis filter | Autocor. | 1537 | 1 | 0.38 | 3.07 |
| | | Durbin | 481 | 1 | 0.12 | 0.96 |
| | Weighting filter | Autocor. | 1581 | 1 | 0.39 | 3.16 |
| | | Durbin | 481 | 1 | 0.12 | 0.96 |
| | Log-gain predictor | Autocor. | 141 | 1 | 0.035 | 0.28 |
| | | Durbin | 481 | 1 | 0.12 | 0.96 |
| Excitation VQ | Codebook energy | | 4672 | 1 | 1.17 | 9.34 |
| | Codebook search | | 2970 | 2 | 1.49 | 11.88 |
| Pitch predictor quantization | lag & taps joint opt. | | 11245 | 1 | 2.81 | 22.49 |
| | pitch extraction | | 4011 | 1 | 1.00 | 8.02 |
| | voice detection | | 562 | 1 | 0.14 | 1.12 |
| | other | | 878 | 1 | 0.22 | 1.76 |
| Filtering and others | | | 8063 | 1 | 2.02 | 16.13 |

TABLE 4

Computational complexity of different tasks in the 8 kb/s LD-CELP decoder.

| Tasks | | | | times | | |
|---|---|---|---|---|---|---|
| | instructions | per 4 ms | No. of DSP32C | (80 ns) | MIPS | % DSP32C |
| LPC analysis | Synthesis filter | Autocor. | 1537 | 1 | 0.38 | 3.07 |
| | | Durbin | 481 | 1 | 0.12 | 0.96 |
| | Log-gain predictor | Autocor. | 141 | 1 | 0.035 | 0.28 |
| | | Durbin | 481 | 1 | 0.12 | 0.96 |
| Postfilter | | | 1832 | 1 | 0.46 | 3.66 |
| Filtering and others | | | 1710 | 1 | 0.43 | 3.42 |

Performance

The 8 kb/s LD-CELP coder has been evaluated against other standard coders operating at the same or higher bitrates and the 8 kb/s LD-CELP has been found to provide the same speech quality with only ⅕ of the delay. Assuming an 8 kb/s transmission channel, for the 4 ms frame version of 8 kb/s LD-CELP in accordance with our implementation of the present invention and assuming that the bits corresponding to pitch parameters are transmitted as soon as they become available in each frame, then a one-way coding delay less than 10 ms can readily be achieved. Similarly, with the 2.5 ms frame version of 8 kb/s LD-CELP, a one-way coding delay between 6 and 7 ms can be obtained, with essentially no degradation in speech quality.

While the above description of embodiments of a low-delay CELP coder/decoder have proceeded largely in terms of an 8 kb/s implementation, it has been found that LD-CELP implementations in accordance with the present invention can be made with bit-rates below 8 kb/s by changing some coder parameters. For example, it has been found that the speech quality of a 6.4 kb/s LD-CELP coder in accordance with the present inventive principles performed almost as well as that of the 8 kb/s LD-CELP, with only minimal re-optimization, all within the skill of practitioners in the art in light of the above teachings. Further, at a bit-rate of 4.8 kb/s, an LD-CELP coder in accordance with the present invention with a frame size around 4.5 ms produces speech quality at least comparable to most other 4.8 kb/s CELP coders with frame sizes reaching 30 ms.

We claim:

1. A device for coding a signal with use of an excitation codebook, the coding based on a set of codebook vector energies for a set of codebook vectors in the excitation codebook, each codebook vector in the set of codebook vectors having an index, the device comprising:

a) means for identifying a set of critical codebook vectors in the set of codebook vectors, the set of codebook vectors comprising the set of critical codebook vectors and a set of non-critical codebook vectors;

b) means for calculating a set of critical codebook vector energies;

c) means for calculating a set of approximations for a set of non-critical codebook vector energies, the set of codebook vector energies comprising the set of non-critical codebook vector energies and the set of critical codebook vector energies; and d) means for coding the signal with use of the excitation codebook, the coding based on the set of codebook vector energies.

2. The device of claim 1 further comprising means for sorting the excitation codebook to generate a sorted excitation codebook, the sorted excitation codebook having the set of critical codebook vectors organized sequentially.

3. The device of claim 1 wherein the means for identifying the set of critical codebook vectors further comprises:

a) means for calculating an energy approximation for each of the codebook vectors to generate a set of energy approximations;

b) means for calculating a standard deviation of each energy approximation in the set of energy approximations; and c) means for defining the set of critical codebook vectors to be the codebook vectors whose energy approximations have the N highest standard deviations, N being an integer less than or equal to the number of codebook vectors in the set of codebook vectors.

4. The device of claim 3 further comprising means for increasing the value of N, whereby the set of codebook energies will contain less approximations in the set of codebook vector energies.

5. The device of claim 3 wherein N is equal to 10.

6. The device of claim 3 wherein N is equal to 16.

7. The device of claim 3 wherein N is substantially equal to approximately one eighth of the number of vectors in the set of codebook vectors.

8. The device of claim 1 wherein the means for calculating the set of approximations further comprises:

a) means for performing an autocorrelation analysis on each codebook vector in the set of non-critical codebook vectors to generate a set of preliminary estimates of energy; and b) means for calculating a set of final energy estimates from the set of preliminary estimates of energy.

9. The device of claim 1 further comprising means for calculating a distortion for each codebook vector in the set of codebook vectors to generate a set of distortions, the set of codebook vector energies being used to calculate the set of distortions and having a one to one correspondence therewith.

10. The device of claim 9 further comprising means for identifying a smallest distortion from the set of distortions.

11. A method for coding a signal with use of an excitation codebook, the coding based on a set of codebook vector energies for a set of codebook vectors in the excitation codebook, each codebook vector in the set of codebook vectors having an index, the method comprising the steps of:

a) identifying a set of critical codebook vectors in the set of codebook vectors, the set of codebook vectors comprising the set of critical codebook vectors and a set of non-critical codebook vectors;

b) calculating a set of critical codebook vector energies;

c) calculating a set of approximations for a set of non-critical codebook vector energies, the set of codebook vector energies comprising the set of non-critical codebook vector energies and the set of critical codebook vector energies; and d) coding the signal with use of the excitation codebook, the coding based on the set of codebook vector energies.

12. The method of claim 11 further comprising the step of sorting the excitation codebook to generate a sorted excitation codebook, the sorted excitation codebook having the set of critical codebook vectors organized sequentially.

13. The method of claim 11 wherein the step of identifying the set of critical codebook vectors further comprises the steps of:

a) calculating an energy approximation for each of the codebook vectors to generate a set of energy approximations;

b) calculating a standard deviation of each energy approximation in the set of energy approximations; and c) defining the set of critical codebook vectors to be the codebook vectors whose energy approximations have the N highest standard deviations, N being an integer less than or equal to the number of codebook vectors in the set of codebook vectors.

14. The method of claim 13 further comprising the step of increasing the value of N, whereby the set of codebook energies will contain less approximations in the set of codebook vector energies.

15. The method of claim 13 wherein N is equal to 10.

16. The method of claim 13 wherein N is equal to 16.

17. The method of claim 13 wherein N is substantially equal to approximately one eighth of the number of vectors in the set of codebook vectors.

18. The method of claim 11 wherein the step of calculating the set of approximations further comprises the steps of:

a) performing an autocorrelation analysis on each codebook vector in the set of non-critical codebook vectors to generate a set of preliminary estimates of energy; and b) calculating a set of final energy estimates from the set of preliminary estimates of energy.

19. The method of claim 11 further comprising the step of calculating a distortion for each codebook vector in the set of codebook vectors to generate a set of distortions, the set of codebook vector energies being used to calculate the set of distortions and having a one to one correspondence therewith.

20. The method of claim 19 further comprising the step of identifying a smallest distortion from the set of distortions.

* * * * *